US010176943B1

(12) United States Patent
Golner et al.

(10) Patent No.: US 10,176,943 B1
(45) Date of Patent: Jan. 8, 2019

(54) HIGH-VOLTAGE SWITCH FOR SERIES/PARALLEL APPLICATIONS AND TAP CHANGER APPLICATIONS

(71) Applicant: SPX Transformer Solutions, Inc., Waukesha, WI (US)

(72) Inventors: Thomas Golner, Pewaukee, WI (US); Jeffrey J. Nemec, Oconomowoc, WI (US); Dharam Vir, Waukesha, WI (US)

(73) Assignee: SPX Transformer Solutions, Inc., Waukesha, WI (US)

( * ) Notice: Subject to any disclaimer, the term of this patent is extended or adjusted under 35 U.S.C. 154(b) by 0 days.

(21) Appl. No.: 15/797,099

(22) Filed: Oct. 30, 2017

(51) Int. Cl.

| | |
|---|---|
| ***H01H 1/38*** | (2006.01) |
| ***H01H 19/12*** | (2006.01) |
| ***H01H 19/08*** | (2006.01) |
| ***H01H 19/14*** | (2006.01) |
| ***H01H 33/24*** | (2006.01) |
| ***H01H 9/48*** | (2006.01) |
| *H01F 29/02* | (2006.01) |
| *H01H 85/02* | (2006.01) |

(52) U.S. Cl.
CPC ..... *H01H 19/12* (2013.01); *H01H 1/385* (2013.01); *H01H 9/48* (2013.01); *H01H 19/08* (2013.01); *H01H 19/14* (2013.01); *H01H 33/24* (2013.01); *H01F 29/02* (2013.01); *H01H 2085/0225* (2013.01)

(58) Field of Classification Search
CPC ..... H01H 1/385; H01H 3/40; H01H 9/0005; H01H 9/48; H01H 15/00; H01H 15/08; H01H 31/32; H01H 33/02
See application file for complete search history.

(56) References Cited

U.S. PATENT DOCUMENTS 5,744,764 A * 4/1998 Aschenbrenner ..... H01H 1/38 200/1 R

* cited by examiner

*Primary Examiner* — Vanessa Girardi
(74) *Attorney, Agent, or Firm* — Baker & Hostetler LLP

(57) ABSTRACT

A switch includes an insulating base having an upper surface and an assembly having a mounting surface. The assembly configured to be arranged on the insulating base, the assembly having a lower surface, the assembly being configured to be arranged on the upper surface of the insulating base with an open space between the lower surface of the assembly and the upper surface of the insulating base. The switch further includes a plurality of fixed contact units mounted in an aligned arrangement on the mounting surface of the assembly and a movable contactor mounted to move within the bore of the insulating body and the electrical contacts of the plurality of fixed contact units.

10 Claims, 21 Drawing Sheets

HIGH-VOLTAGE SWITCH FOR SERIES/PARALLEL APPLICATIONS AND TAP CHANGER APPLICATIONS

FIELD OF THE DISCLOSURE

The disclosure is generally directed to high voltage high current electrical switching devices. More specifically, the disclosure is directed to high voltage high current switching devices such as tap changing switches in power transformer applications and series/parallel applications.

BACKGROUND OF THE DISCLOSURE

Large high voltage transformers typically have tap changing mechanisms associated with primary windings of the transformer to allow primary to secondary turn ratios to be adjusted. The adjustments are typically used to compensate for variations in line voltage.

A tap changing mechanism for a transformer typically includes a series of fixed contacts. The series of fixed contacts may be connected to the taps of the primary winding of the transformer. The series of fixed contacts are typically arranged within the transformer tank and immersed in a transformer oil. A movable contact is moved between the contacts with a drive mechanism.

A size of conventional tap changing switches and a required spacing for electrical isolation within the transformer generally imposes a constraint on the minimum size of the transformer tank. Additionally, typical tap changing switches have a limited maximum operating voltage.

Accordingly, what is needed is a more compact tap changing switch that is configured to operate at higher voltages.

SUMMARY OF THE DISCLOSURE

The foregoing needs are met, to a great extent, by the disclosure, wherein in one aspect a technique and apparatus are provided for a more compact tap changing switch that is configured to operate at higher voltages.

In accordance with one aspect a switch having an insulating base having an upper surface, an assembly having a mounting surface, the assembly configured to be arranged on the insulating base, the assembly having a lower surface, the assembly being configured to be arranged on the upper surface of the insulating base with an open space between the lower surface of the assembly and the upper surface of the insulating base, a plurality of fixed contact units mounted in an aligned arrangement on the mounting surface of the assembly, each of the plurality of fixed contact units comprising an insulating body with a bore therethrough, an electrical contact embedded in the insulating body of each of the plurality of fixed contact units and the bore of the insulating body having the electrical contact arranged in the insulating body, the plurality of fixed contact units mounted to the mounting surface of the assembly such that the bore of the insulating body and electrical contacts of the fixed contact units are linearly aligned, a movable contactor mounted to move within the bore of the insulating body and the electrical contacts of the plurality of fixed contact units, the movable contactor having a cylindrical body with contact louvers at spaced positions on the cylindrical body with the cylindrical body providing electrical conduction between the contact louvers, the movable contactor configured to slide within the fixed contact units with the contact louvers sized to engage the electrical contacts within the fixed contact units, and a drive shaft attached to the movable contactor configured such that the movable contactor is driven through the bore of the fixed contact units by moving the drive shaft whereby the movable contactor is configured to be moved from a position in which one of the contact louvers of the movable contactor engages the electrical contact in a first of the plurality of fixed contact units to a position wherein one contact louver engages the electrical contact within another one of the plurality of fixed contact units.

In accordance with another aspect a switch having an insulating base having an upper surface, an assembly having a mounting surface, the assembly configured to be arranged on the insulating base, the assembly having a lower surface, a plurality of fixed contact units mounted in an aligned arrangement on the mounting surface of the assembly, each of the plurality of fixed contact units comprising an insulating body with a bore therethrough, an electrical contact embedded in the insulating body of each of the plurality of fixed contact units and the bore of the insulating body having the electrical contact arranged in the insulating body, the plurality of fixed contact units mounted to the mounting surface of the assembly such that the bore of the insulating body and electrical contacts of the fixed contact units are linearly aligned, the plurality of fixed contact units mounted in an aligned arrangement on the mounting surface of the assembly are configured with an open space between each of the plurality of fixed contact units, a movable contactor mounted to move within the bore of the insulating body and the electrical contacts of the plurality of fixed contact units, the movable contactor having a cylindrical body with contact louvers at spaced positions on the cylindrical body with the cylindrical body providing electrical conduction between the contact louvers, the movable contactor configured to slide within the fixed contact units with the contact louvers sized to engage the electrical contacts within the fixed contact units, and a drive shaft attached to the movable contactor configured such that the movable contactor is driven through the bore of the fixed contact units by moving the drive shaft whereby the movable contactor is configured to be moved from a position in which one of the contact louvers of the movable contactor engages the electrical contact in a first of the plurality of fixed contact units to a position wherein one contact louver engages the electrical contact within another one of the plurality of fixed contact units.

There has thus been outlined, rather broadly, certain aspects of the disclosure in order that the detailed description thereof herein may be better understood, and in order that the present contribution to the art may be better appreciated. There are, of course, additional aspects of the disclosure that will be described below and which will form the subject matter of the claims appended hereto.

In this respect, before explaining at least one aspect of the disclosure in detail, it is to be understood that the disclosure is not limited in its application to the details of construction and to the arrangements of the components set forth in the following description or illustrated in the drawings. The disclosure is capable of aspects in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the disclosure. It is important, therefore, that the claims be regarded as including such equivalent constructions insofar as they do not depart from the spirit and scope of the disclosure.

DETAILED DESCRIPTION OF THE DISCLOSURE

Figure 1:
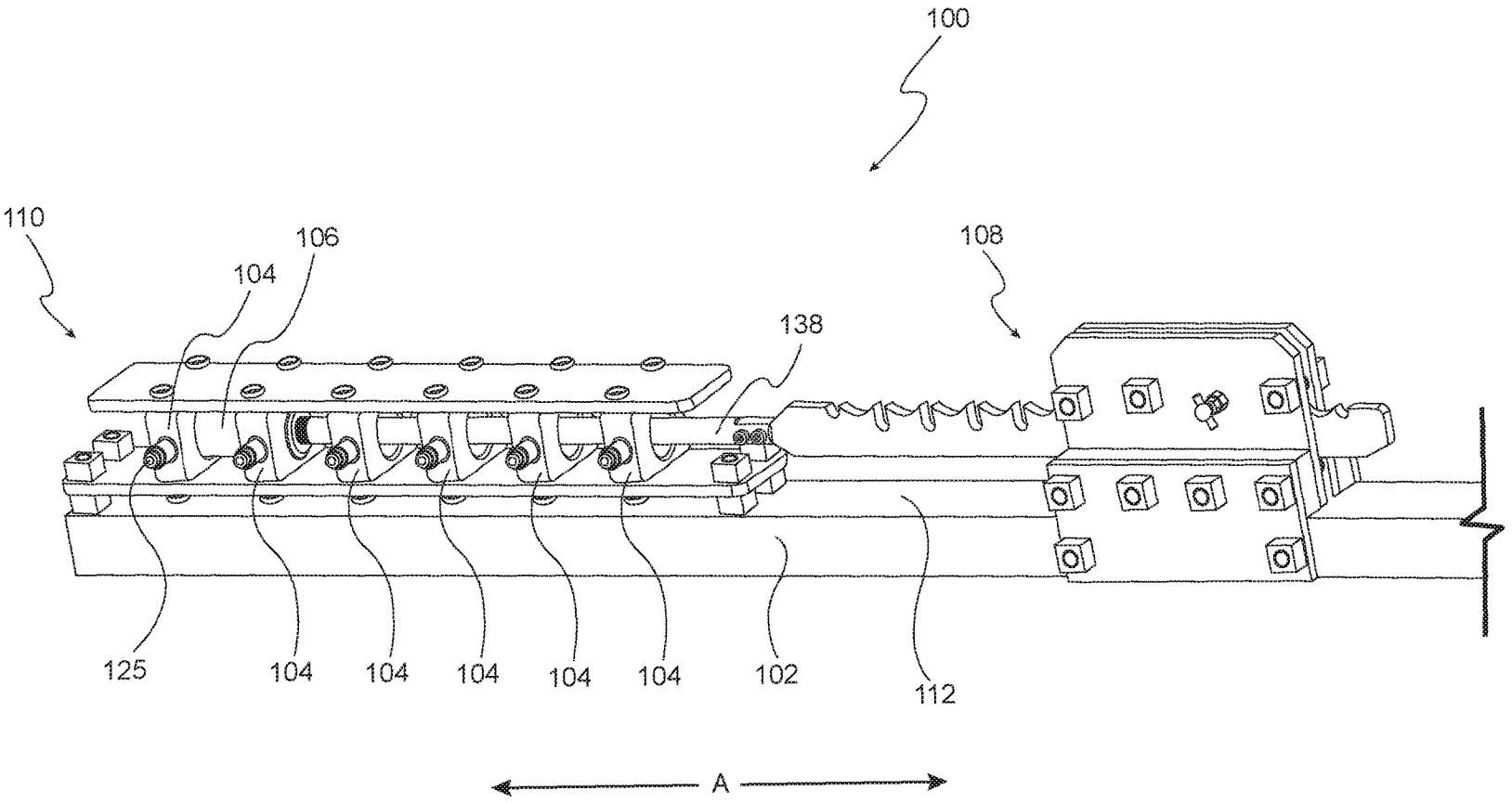
FIG. 1 illustrates a perspective view of a switch for a tap changer in accordance with aspects of the disclosure.

FIG. 1 illustrates a perspective view of a switch for a tap changer in accordance with aspects of the disclosure. In particular, FIG. 1 illustrates a tap changing switch 100 in accordance with the disclosure that can be connected to the taps of a single phase transformer, multi-phase transformer, or the like. The tap changing switch 100 may have an elongated, generally rectangular insulating base 102 on which may be mounted an assembly 110 that may include a series of fixed contact units 104 aligned in a row along the assembly 110. The assembly 110 may be arranged on a top surface 112 of the insulating base 102.

Changing of taps by the tap changing switch 100 may be achieved by a sliding motion of a movable contactor 106, accommodating the use of a simplified drive mechanism 108 for the movable contactor 106. Multiple tap changing switches 100 may be mounted in a compact side-by-side (not shown) or end-to-end relationship (shown in FIG. 21) such that the multiple tap changing switches 100 may be operated by a single drive mechanism 108.

In particular, it should be noted that the tap changing switch 100 is shown with six fixed contact units 104. However, in other aspects, the tap changing switch 100 may be implemented with four fixed contact units 104. Moreover, it should be noted that any number of fixed contact units 104 may be employed in the tap changing switch 100.

Figure 2:
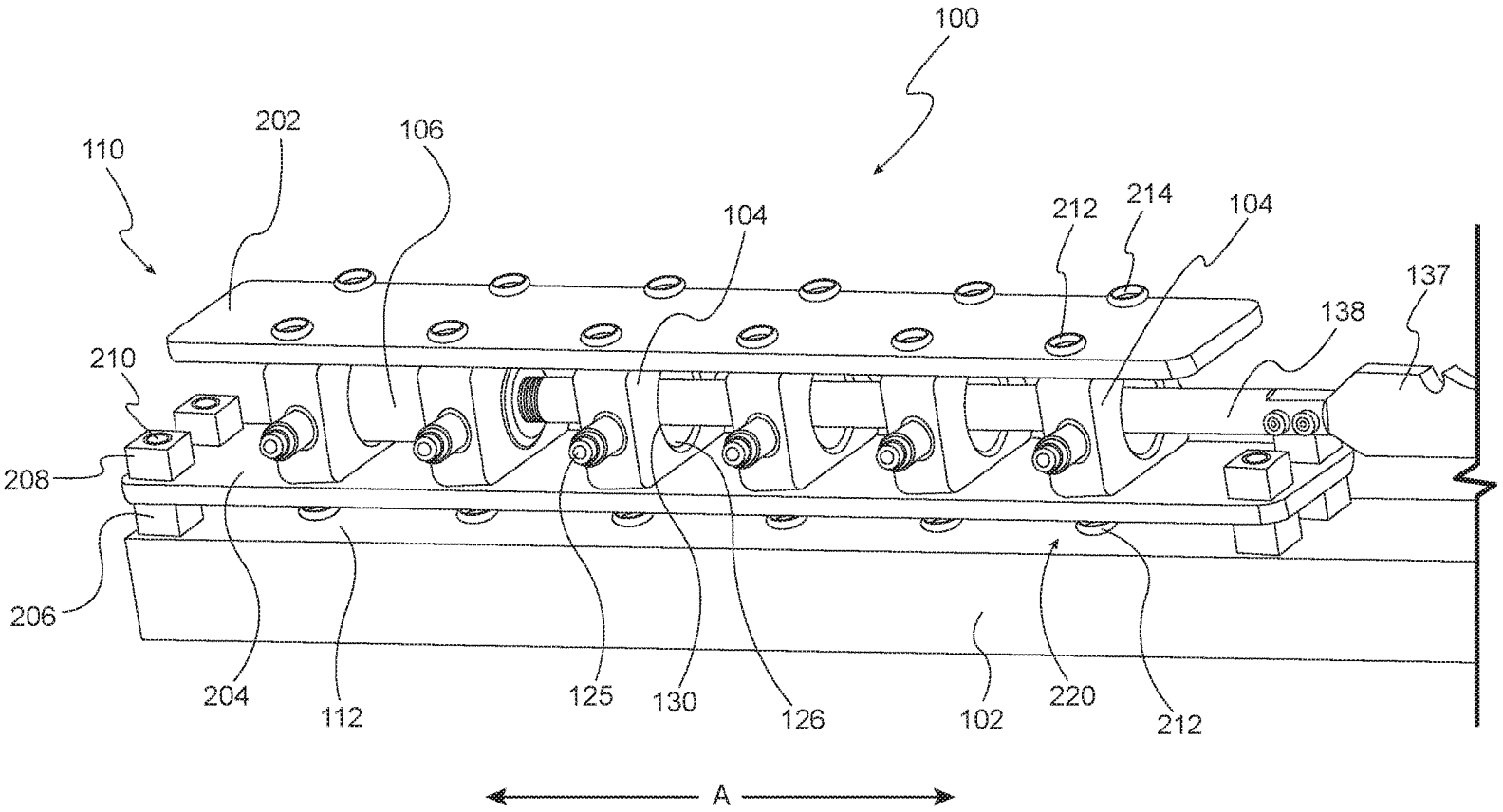
FIG. 2 illustrates a partial perspective view of the switch for the tap changer of FIG. 1.

FIG. 2 illustrates a partial perspective view of the switch for transformer tap changer of FIG. 1. The mounting of the fixed contact units 104 to the assembly 110 is illustrated in FIG. 2. The tap changing switch 100 of the disclosure may include the elongated insulating base 102 on which the assembly 110 is mounted. The assembly 110 may include several of the fixed contact units 104 mounted therein. In particular, the assembly 110 may include a top plate 202 and a bottom plate 204 configured to hold the fixed contact units 104. In one aspect, the top plate 202 and the bottom plate 204 may be constructed with a thermosetting resin. In one aspect, the top plate 202 and the bottom plate 204 may be constructed with a thermosetting phenolic resin. In one aspect, the phenolic may be a paper-based phenolic having a nominally XX grade.

The bottom plate 204 may include standoffs 206 to support the bottom plate 204 above the top surface 112 of the insulating base 102. The bottom plate 204 may further include strengthening portions 208. The strengthening portions 208 together with the standoffs 206 may include apertures that are aligned with a corresponding aperture of the bottom plate 204 to receive a fastener 210 therethrough for fastening the bottom plate 204 to the insulating base 102. The fastener 210 may be a bolt, screw, or the like. In one aspect, the fastener 210 is a screw that is screwed into the insulating base 102. As further shown in FIG. 2, there may be a plurality of standoffs 206, strengthening portions 208, fasteners 210 for fastening the bottom plate 204 to the insulating base 102. In this regard, there may be four such constructions for holding the bottom plate 204 to the insulating base 102, one at each corner. However, any number may be employed.

Each of the fixed contact units 104 may be attached to the bottom plate 204. Likewise, each of the fixed contact units 104 may be attached to the top plate 202. Each of the fixed contact units 104 may be attached to the top plate 202 with a fastener 214 that extends through a corresponding aperture in the top plate 202. The fastener 214 may extend through a corona ring 212 as well. The corona ring 212 receiving the fastener 214 through the corona ring 212. In a similar manner, a fastener 214 and corona ring 212 may also be utilized in a similar manner to attach the fixed contact units 104 to the bottom plate 204. The fastener 214 may be a bolt, screw, or the like. In one aspect, the fastener 214 is a bolt and the fixed contact unit 104 includes a threaded aperture. In one aspect, each fixed contact unit 104 may include two fasteners 214 and two corona rings 212 for attachment to the top plate 202 and each fixed contact unit 104 may include two fasteners 214 and two corona rings 212 for attachment to the bottom plate 204. However, any number may be employed.

The assembly 110 may be configured with an open space 220 between the bottom plate 204 and the insulating base 102. The open space 220 providing sufficient clearance in order for the fasteners and corona rings 212 to be positioned below each of the respective fixed contact units 104. Additionally, the construction of the assembly 110 allows manufacturing to be simplified in the sense that the assembly 110 together with the fixed contact units 104 may be assembled prior to attachment to the insulating base 102. Moreover, this construction allows the assembly 110 to be installed in an existing insulating base 102 without the need for replacement of the insulating base. For example, retrofitting an existing insulating base 102 with a new assembly 110 and new fixed contact units 104.

Figure 5:
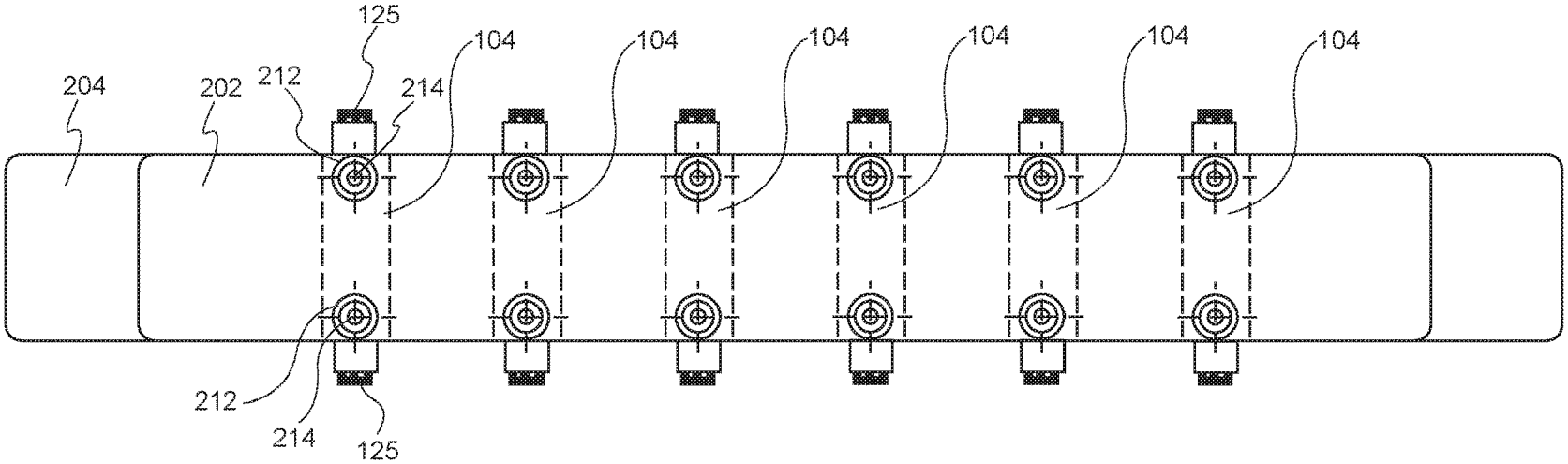
FIG. 5 illustrates a partial top view of the switch for the tap changer of FIG. 1.
Figure 6:
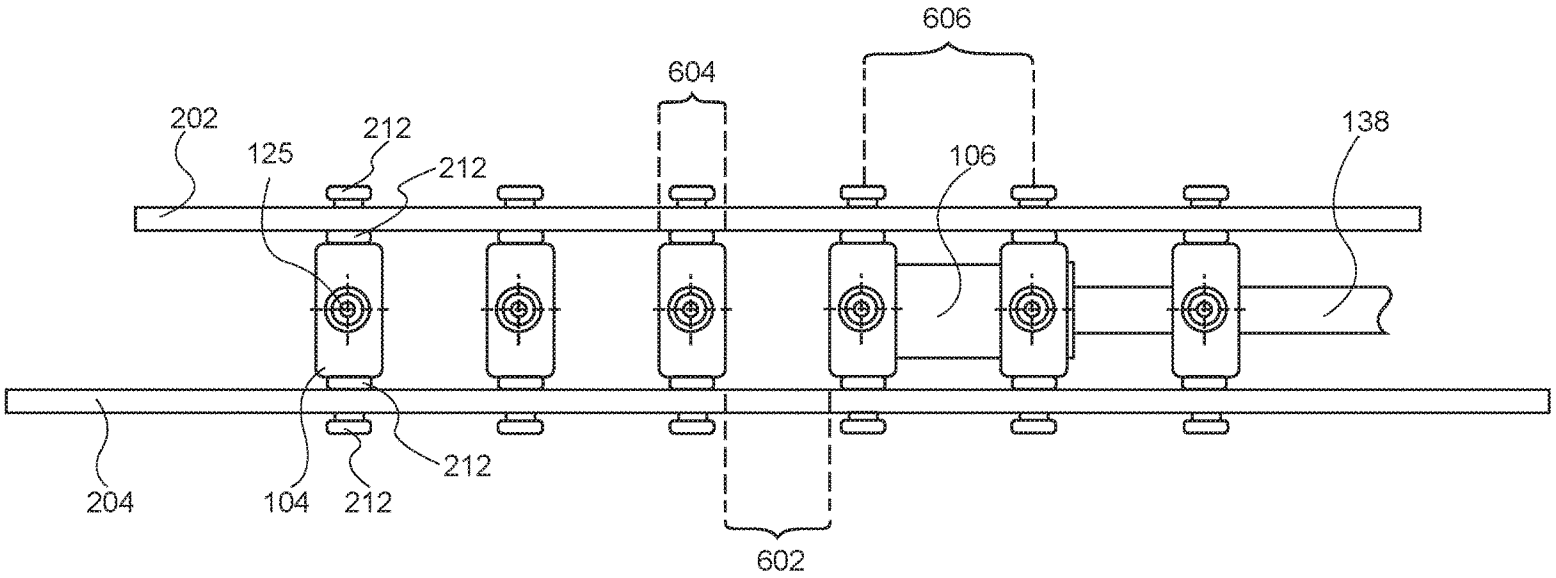
FIG. 6 illustrates a partial front view of the switch for the tap changer of FIG. 1.

FIG. 5 illustrates a partial top view of the switch for the tap changer of FIG. 1; and FIG. 6 illustrates a partial front view of the switch for the tap changer of FIG. 1. In particular, FIG. 5 illustrates the arrangement of the corona rings 212 on the top plate 202 and the bottom plate 204; and FIG. 6 illustrates that an electrical connector 125 may be implemented on both sides of the fixed contact units 104.

In one aspect, the fixed contact units 104 may be aligned in a row along the assembly 110 and spaced from one another such that there is a gap or open space 602 between adjacent fixed contact units 104 as shown in FIG. 5. In one aspect, a width of the gap or open space 602 is greater than the width 604 of one of the fixed contact units 104. In one aspect, the width 604 may be 30 mm-50 mm. In one aspect, the width 604 may be 35 mm-45 mm. In one aspect, the width 604 may be 36 mm-42 mm. In one aspect, the width 604 may be 37 mm-39 mm.

The tap changing switch 100 in accordance with the disclosure has a compact construction that reduces a space within a transformer tank occupied by the tap changing switch 100 or tap changing switches. In one aspect, the fixed contact units 104 may be arranged between 70 mm and 230 mm on center (distance 606 shown in FIG. 5). In one aspect, the fixed contact units 104 may be arranged between 80 mm and 120 mm on center. In one aspect, the fixed contact units 104 may be arranged between 90 mm and 110 mm on center. In one aspect, the fixed contact units 104 may be arranged between 95 mm and 105 mm on center. In one aspect, the fixed contact units 104 may be arranged between 140 mm and 180 mm on center. In one aspect, the fixed contact units 104 may be arranged between 150 mm and 170 mm on center. In one aspect, the fixed contact units 104 may be arranged between 180 mm and 220 mm on center. In one aspect, the fixed contact units 104 may be arranged between 190 mm and 210 mm on center. In one aspect, the fixed contact units 104 may be arranged about 100 mm on center (plus or minus 2 mm). In one aspect, the fixed contact units 104 may be arranged about 160 mm on center (plus or minus 2 mm). In one aspect, the fixed contact units 104 may be arranged about 200 mm on center (plus or minus 2 mm). In one aspect, the fixed contact units 104 may be arranged between 90 mm and 110 mm on center for implementations of the tap changing switch 100 operating at 300 kV or less. In one aspect, the fixed contact units 104 may be arranged between 150 mm and 170 mm on center for implementations of the tap changing switch 100 operating at 750 kV or less. In one aspect, the fixed contact units 104 may be arranged between 190 mm and 210 mm on center for implementations of the tap changing switch 100 operating at 900 kV or less. This allows a transformer size to be reduced as well.

The construction of the top plate 202 and the bottom plate 204 illustrated in FIGS. 2, 5, and 6 provide a very strong and compact design for high-voltage switches such as the tap changing switch 100 for use in power transformers. Moreover, the construction of the top plate 202 and the bottom plate 204 illustrated in FIGS. 2, 5, and 6 is configured to provide a voltage rating of up to and exceeding 115 kV.

Figure 4:
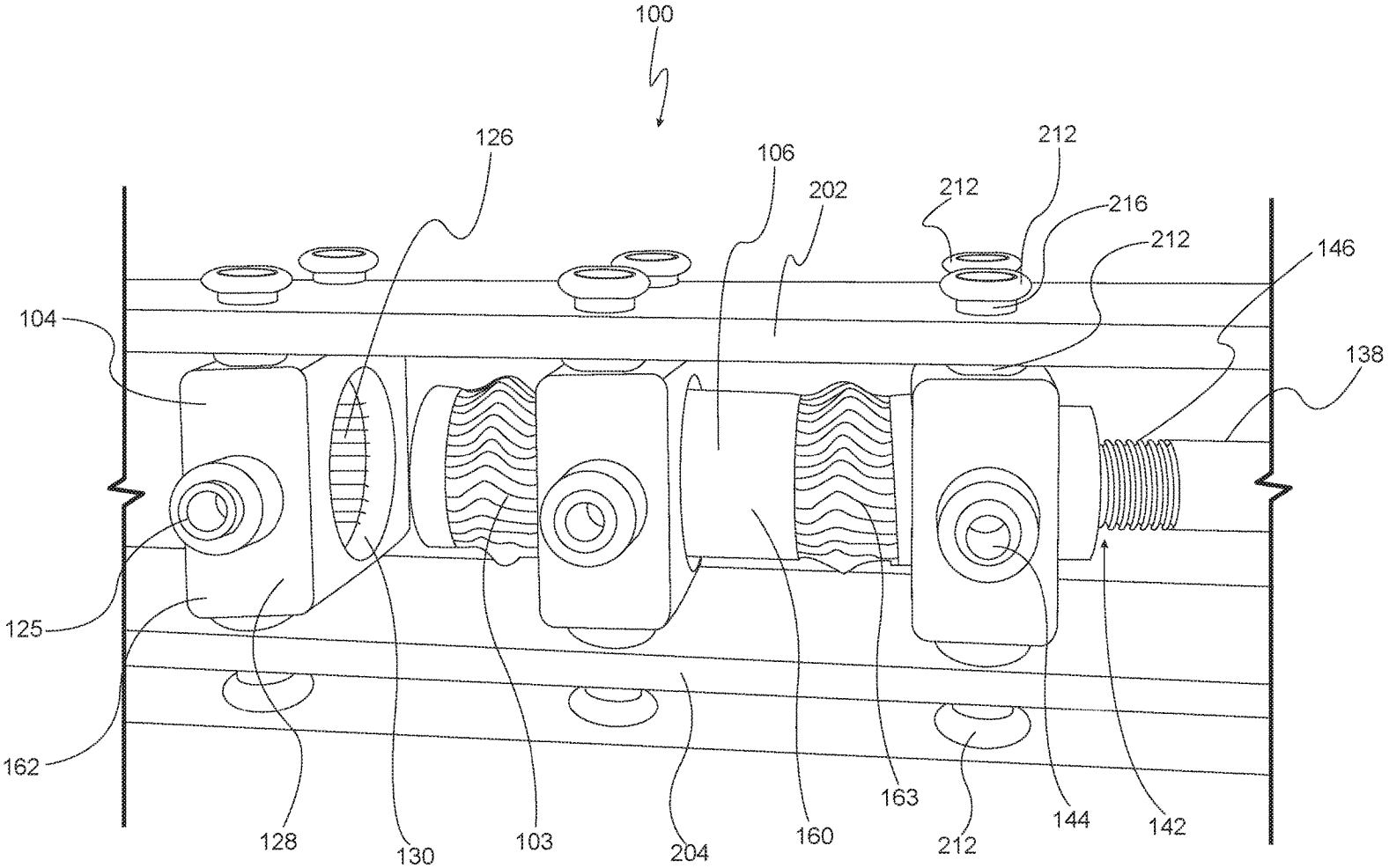
FIG. 4 illustrates another partial perspective view of the switch for the tap changer of FIG. 1.

FIG. 4 illustrates another partial perspective view of the switch for transformer tap changer of FIG. 1. As shown in FIG. 4, each fixed contact unit 104 may have an identical construction that may include an insulating body 128 in which an electrical contact 126 is embedded. The fixed contact unit 104 may include a hollow bore 130 formed through the insulating body 128 with the electrical contact 126 arranged therein. The electrical contact 126 may be formed in the middle of the insulating body 128, spaced away from openings of the internal bores 130 at each end of the fixed contact unit 104. Several of the fixed contact units 104 may be mounted in alignment in the assembly 110 arranged on the insulating base 102 so that their bores 130 are aligned, allowing the movable contactor 106 to be driven through the bores 130 of the fixed contact units 104 by a drive shaft 138 to change switch positions.

The movable contactor 106 may be formed substantially as an elongated cylinder of a good electrical conductor, such as a metal. The metal may be copper, aluminum, brass, and the like. In one aspect, the metal of the movable contactor 106 may be silver plated.

The movable contactor 106 may include two spaced contact louvers 163 formed on a body 160 of the movable contactor 106. The contact louvers 163 may have spring loaded portions that extend beyond a diameter of the adjacent body 160 of the movable contactor 106 so as to make tight physical contact with the inner bore 130 of the electrical contact 126 in the fixed contact units 104, while allowing the body 160 of the movable contactor 106 to move unimpeded through the bores 130 of the fixed contact units 104. The spacing between the contact louvers 163 on the movable contactor 106 matches the spacing between the electrical contacts 126 in adjacent fixed contact units 104. When the movable contactor 106 is in position with its contact louvers 163 engaging the cylindrical bores 130 of the electrical contacts 126 in adjacent fixed contact units 104, a low resistance electrical connection may be formed at many points across an entire internal periphery of the bore 130 of the fixed contact units 104 to the contact louver 163. The body of the movable contactor 106 may be in good electrical contact with the contact louvers 163 thereby providing a low resistance electrical connection between the two adjacent fixed contact units 104.

To change switch positions, a drive shaft 138 may be moved parallel to a direction of arrows A to drive the movable contactor 106 through the bores 130 of the fixed contact units 104 until the contact louvers 163 of the movable contactor are engaged with the internal bores of electrical contacts 126 in two other adjacent fixed contacts units 104 as shown in FIG. 2. The electrical connector 125 in each fixed contact unit 104 may extend out from the insulating body 128 of the fixed contact unit 104 to form a mounting to which a conductor from the transformer can be connected.

The insulating base 102 provides structural support for the assembly 110 and the fixed contact units 104 and movable contactor 106, but may be made relatively thin and need only be somewhat wider than the width of the fixed contact units 104, thereby minimizing the overall height and width of each tap changing switch 100 and providing a very compact structure. Thus, the volume occupied in the transformer tank by the tap changing switches 100 between the transformer and the walls of the tank is minimal, allowing the overall size of the transformer tank to be minimized. Generally, the relatively elongated tap changing switches 100 of the disclosure are readily accommodated within a conventional transformer tank, so that best advantage of the volume of the tank is made by the present disclosure. If desired, the tap changing switch 100 may also be incorporated into a structure in the tank that has other purposes.

The contact louvers 163 of the movable contactor 106 make tight physical and electrical contact with the cylindrical bores 130 of the electrical contacts 126 of the fixed contact units 104 at multiple positions extending around the entire 360° internal bore 130 periphery. Consequently, the flow of electricity is optimally distributed around the entire inner periphery of the fixed contact unit 104 and around the entire outer periphery of the movable contactor 106 body 160 adjacent the contact louvers 163, making full use of the entire surface areas of these structures. In this manner, hot spots in the fixed contact units 104 and movable contactor 106 are minimized and the sizes of these structures may be minimized for a given level of current to be conducted by these conductors. The contact louvers 163 may be spring loaded structures which engage the bore 130 of the fixed contact unit 104 tightly at many points, and which may increase the contact pressure on the inside of the fixed contact unit 104 under short circuit conditions.

Although the tap changing switch 100 of the disclosure is particularly well suited for use as a tap changing switch, it may be used in other appropriate applications. For example, it may be used with transformers designed for reconnection of internal leads from an external source (e.g., series/parallel re-connectable). Such transformers use pairs of windings per phase which can be connected in series or parallel with one another. Each winding may have taps, requiring tap changing switches 100 for that purpose also.

Each of the fixed contact units 104 may have the electrical connector 125 forming part of an electrical contact 126. The electrical connector 125 extends from the side 162 of the fixed contact unit 104. Electrical conducting lines, leading to the taps of the transformer (not shown), are connected to the electrical connector 125 by lugs, conductors, and the like. The electrical connector 125 may have tapered interference fit ridges formed thereon to ensure multiple contact points on the electrical connector 125.

Figure 3:
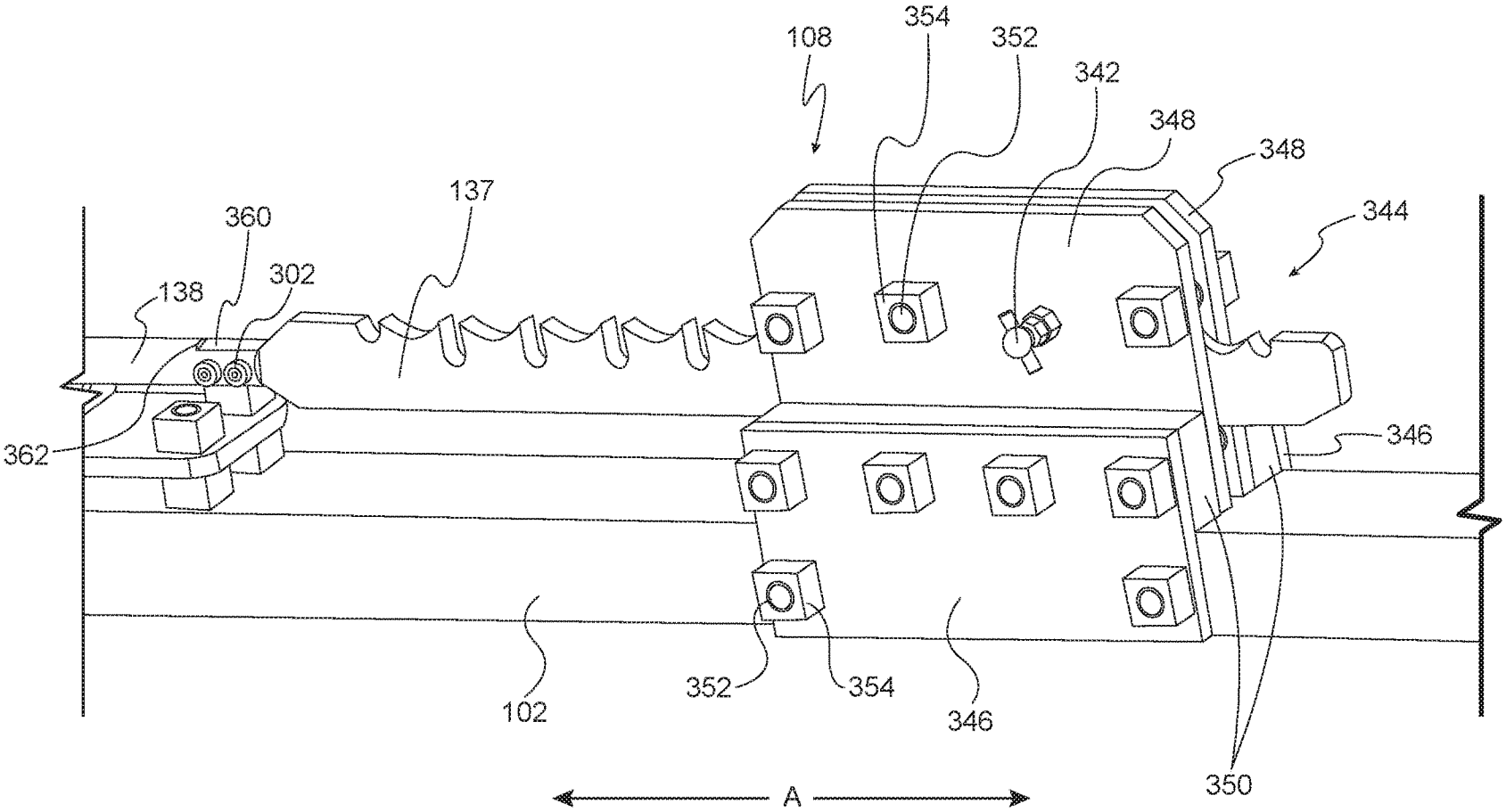
FIG. 3 illustrates another partial perspective view of the switch for the tap changer of FIG. 1.

FIG. 3 illustrates another partial perspective view of the switch for the tap changer of FIG. 1. The movable contactor 106 may be mounted for motion within the fixed contact units 104 at the end of the drive shaft 138. The drive shaft 138 may be attached to the end of an elongated rack 137. In one aspect, the drive shaft 138 may be attached to the end of an elongated rack 137 with mechanical fasteners 302. The fasteners 302 may be a bolt, screw, or the like. In this regard, the drive shaft 138 may include a slot 362 and the rack 137 may include an extension received in the slot 362. A material for the rack 137 and other drive mechanism 108 components may include a dielectric material such as thermosetting resin, a thermosetting phenolic resin, a linen/epoxy laminated material, or the like. In one aspect, the phenolic may be a paper-based phenolic having a nominally XX grade.

The rack 137 slides in a channel of a rack guide 344 on the insulating base 102. The rack guide 344 may include two side plates 348 positioned and arranged with the rack 137 in between. The two side plates 348 may be held together with one or more mechanical fasteners 352. The fasteners 352 may be a bolt, screw, or the like. The two side plates 348 may include fastener support structures 354 configured to hold the one or more mechanical fasteners 352.

The rack guide 344 may further include two outer plates 346 with spacers 350 arranged between the two outer plates 346 and the two side plates 348. The two outer plates 346 may be held together with one or more mechanical fasteners 352. The two outer plates 346 may include fastener support structures 354 configured to hold the one or more mechanical fasteners 352.

A handle 342 may be mounted on one the two side plates 348. An index display unit (not shown) can be mounted to the handle 342 to indicate to an operator the present tap position. In one aspect, a single full revolution of the handle 342 may correspond to one change of tap position.

As is apparent, rotating the handle 342, thereby rotating a shaft and a drive wheel connected to it, drives the rack 137 laterally in one direction or the other (along arrows A) to drive the movable contactor 106 in one direction or another (along arrows A). The handle 342 may be operably connected to a shaft to a Geneva gear system as described below in conjunction FIG. 9, to index the motion of the rack 137 in a step-by-step manner. Other types of drive mechanisms are contemplated as well.

The insulating base 102 may be formed of a structurally strong material which is essentially electrically non-conductive. A convenient and suitable material for the elongated insulating base 102 may be a thermosetting resin, a thermosetting phenolic resin, precompressed pressboard, wood, fiberboard, fiberglass composites, plastics, etc. In one aspect, the phenolic may be a paper-based phenolic having a nominally XX grade.

Each fixed contact unit 104 may be substantially identical in construction, facilitating the modularity of assembly of the tap changing switch 100 of the disclosure. Each fixed contact unit 104 may have an insulating body 128 may be molded of a structurally strong insulating material, such as cast epoxy. The electrical contact 126 may be firmly embedded in the insulating body 128 by casting liquid epoxy around the electrical contact 126 in a mold and then curing the epoxy. A suitable material for the body is an epoxy with a hydrated alumina filler.

As illustrated in FIG. 4, the electrical contact 126 may be formed of a good metal conductor, such as electrical grade copper, aluminum, or the like. In one aspect, the metal conductor of the electrical contact 126 may be silver plated. In one aspect, the rectangular shaped insulating body 128 includes the electrical connector 125 which extends therefrom. The rectangular shaped insulating body 128 may have the central bore 130 which is substantially cylindrical.

In one aspect, as shown in FIG. 4, the bore 130 includes the electrical contact 126. As illustrated in FIG. 4, the electrical connector 125 of the fixed contact units 104 may have a tapped hole 144 therein, into which the contact bolt can thread to attach lugs, conductors, and the like firmly in place.

The construction for the movable contactor 106 is shown in more detail in FIG. 4. As illustrated in FIG. 4, the movable contactor 106 has a substantially cylindrical body 160 formed of a good conducting metal such as electrical grade copper, aluminum, or the like. In one aspect, the movable contactor 106 may be metallic with a silver plating. In various aspects, the movable contactor 106 may be implemented as a plurality of movable contactors 106.

The outside diameter of the cylindrical body 160 may be slightly less than the inside diameter of the bore 130 of the electrical contact 126, so that the cylindrical body 160 of the movable contactor may pass relatively freely through both the bore 130 of the electrical contact 126. One end of the cylindrical body 160 may have tapped blind hole 142 therein to allow a threaded end 146 of the drive shaft 138 to be screwed into the hole 142 to firmly mount the movable contactor 106 at the end of the drive shaft 138. The drive shaft 138 connecting the movable contactor 106 may be formed of a good electrically insulating material, such as a thermosetting resin. In one aspect, the drive shaft 138 may be constructed with a thermosetting phenolic resin. In one aspect, the phenolic may be a paper-based phenolic having a nominally LE grade.

As further shown in FIG. 4, the connection between the fixed contact units 104 to the top plate 202 and the bottom plate 204 may be through a fastener extending through the corona ring 212 and the top plate 202 or the bottom plate 204. Additionally, another corona ring 212 may be arranged between the fixed contact units 104 and a top plate 202 and another corona ring 212 may be arranged similarly between the fixed contact unit 104 and the bottom plate 204. Additionally, a fiber washer 216 may be arranged on top of the top plate 202 and on the bottom of the bottom plate 204 with the corona ring 212 arranged thereon. In each case, the mechanical fastener will extend through the corona ring 212, the fiber washer 216 the top plate 202/bottom plate 204 and through the corona ring 212 before extending into the fixed contact unit 104.

The movable contactor 106 may have spring loaded contact louvers 163 mounted to the cylindrical body 160 at spaced positions near the ends of the cylindrical body 160. The mounting of the contact louver 163 to the cylindrical body 160 is best shown in FIG. 4. In one aspect, each contact louvers 163 may be mounted two spaced grooves that may be formed in the periphery of the cylindrical body 160. The grooves may be separated by a cylindrical area which may be machined down slightly from the diameter of the rest of the cylindrical body 160.

The contact louvers 163 may be formed of a corrugated metal contact structure which has spring loaded raised sections generally separated by intermediate sections which contact the depressed areas. The raised sections extend outwardly beyond the diameter of the adjacent surface of the cylindrical body 160. The extending spring loaded sections of the contact louvers 163 extend out to a diameter which is greater than the inside diameter of the bores 130 of the electrical contacts 126 within the fixed contact units 104, thus ensuring a tight physical contact between the spring loaded sections at many positions around the entire 360° periphery of the internal bore 130.

Each of the contact louvers 163 may be wrapped around the periphery of the body 160 between the grooves and secured in place, for example, using retaining rings engaging the edges of the contact louver 163 at each groove. The contact pressure between the contact section and the walls of the bore 130 in contact therewith will increase under short circuit conditions to minimize the contact resistance.

The spacing between the contact louvers 163 on the movable contactor 106 and the spacing between the center points of the electrical contacts 126 in adjacent fixed contact units 104, when such units are engaged to one another, are selected to match. Although it is desirable that the fixed contact units 104 be of standardized construction and size, the bodies of the fixed contact units 104 may be made larger or smaller in length to provide different spacing between the electrical contacts 126 in adjacent contact units 104. Alternatively, spacers (not shown) of insulating material may be mounted between adjacent fixed contact units 104 to provide a desired greater spacing between such units. The length of the cylindrical movable contactor 106 will then be greater, allowing for greater spacing between the contact louvers 163 to match the new spacing between the adjacent fixed contact units.

Of course, it is apparent that other types of contacts may be used for the contact louvers 163, or the contact louvers 163 may be formed integrally with the body 160, and spring loaded contacts may alternatively be provided on the interior of the electrical contact 126.

Figure 7A:
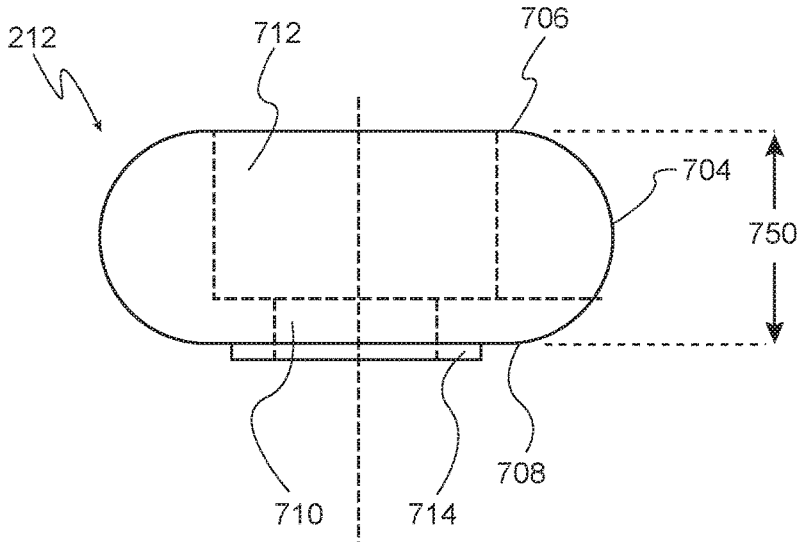
FIG. 7A and FIG. 7B illustrate side and bottom views respectively of a first aspect of a corona ring of the switch for the tap changer of FIG. 1.
Figure 7B:
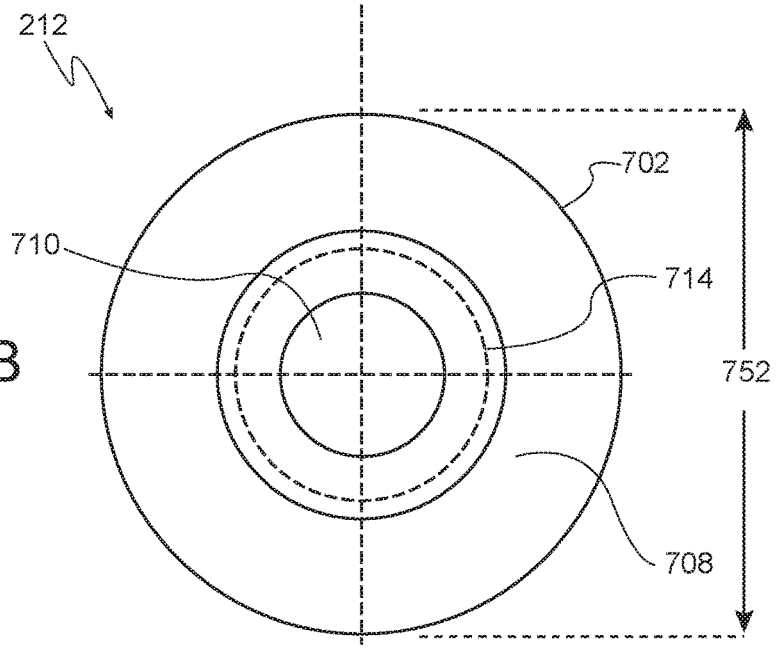

FIG. 7A and FIG. 7B illustrate side and bottom views respectively of a first aspect of a corona ring for the switch for the tap changer of FIG. 1. As shown in FIG. 7, the corona ring 212 may include a circular outer surface 702 and a flat bottom surface 708. The corona ring 212 may include a smaller diameter aperture 710 configured to receive therethrough a fastener such as the fastener 214 shown in FIG. 2.

As shown in FIG. 7, a larger diameter aperture 712 may be sized to receive the fastener head therein. The corona ring 212 may include a curved side surface 704 and a generally flat top surface 706. Additionally, the corona ring 212 may include a circular standoff portion 714. The circular standoff portion 714 may contact a surface of the top plate 202 or a bottom surface of the bottom plate 204. In some aspects, the corona ring 212 may have an epoxy coating on portions thereof. The epoxy coating in some aspects may be 75-150 μm in thickness. In some aspects, the corona rings 212 are only epoxy coated on the curved side surface 704. In this aspect, no other surface of the corona ring 212 may be coated with the epoxy coating.

In some aspects, the corona ring 212 may have a thickness 750 and a diameter 752 that may eliminate the need for insulating washers. This may simplify manufacturer and reduce costs. In one aspect, the thickness 750 of the corona ring 212 may be 0.3 inches to 0.7 inches. In one aspect, the thickness 750 of the corona ring 212 may be 0.4 inches to 0.6 inches. In one aspect, the thickness 750 of the corona ring 212 may be 0.45 inches to 0.55 inches. In one aspect, the thickness 750 of the corona ring 212 may approximately 0.5 inches. In one aspect, the diameter 752 of the corona ring 212 may be 1 inches to 1.5 inches. In one aspect, the diameter 752 of the corona ring 212 may be 1.1 inches to 1.4 inches. In one aspect, the diameter 752 of the corona ring 212 may be 1.2 inches to 1.3 inches. In one aspect, the diameter 752 of the corona ring 212 may be approximately 1.25 inches.

Figure 8A:
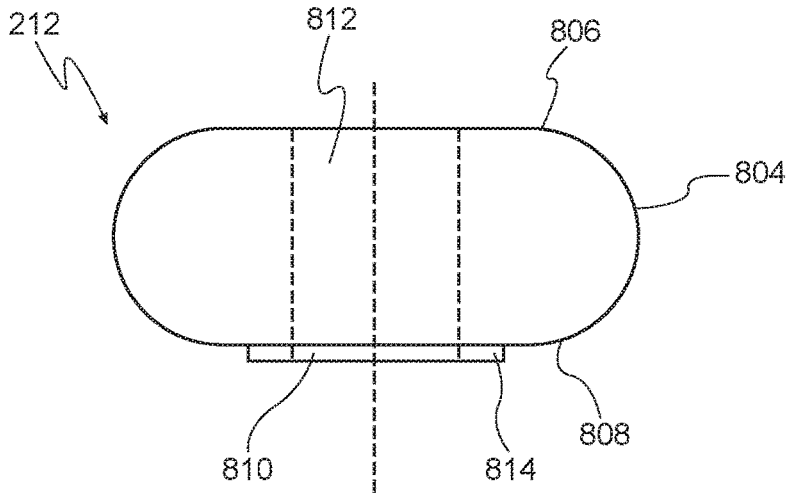
FIG. 8A and FIG. 8B illustrate side and top views respectively of a second aspect of a corona ring of the switch for the tap changer of FIG. 1.
Figure 8B:
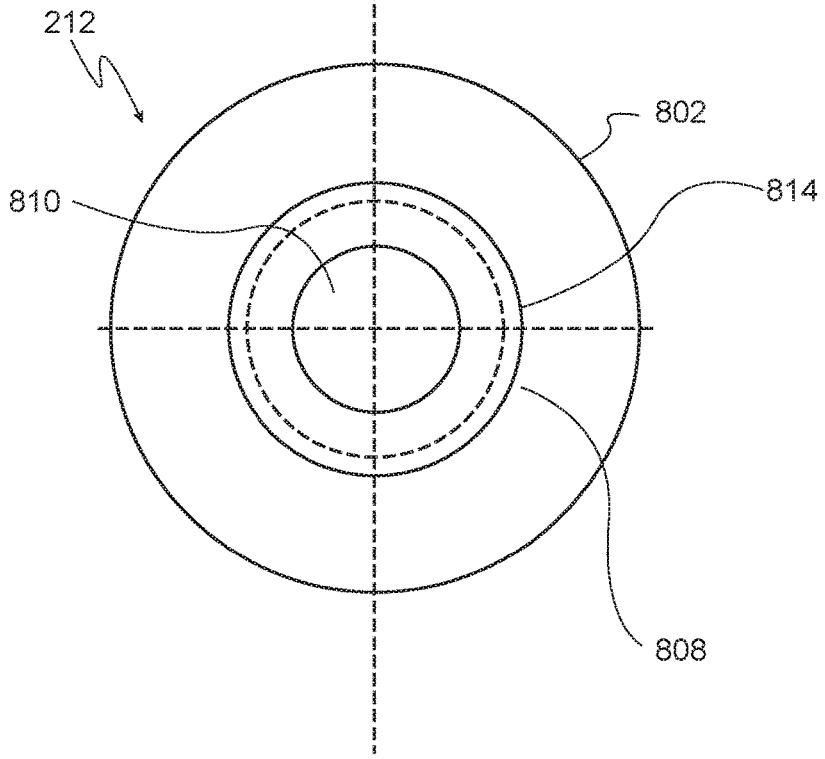

FIG. 8A and FIG. 8B illustrate side and top views respectively of a second aspect of a corona ring of the switch for the tap changer of FIG. 1. As shown in FIG. 8, the corona ring 212 may include a circular outer surface 802 and a flat bottom surface 808. The corona ring 212 may include a smaller diameter aperture 810 configured to receive therethrough a fastener such as the fastener 214 shown in FIG. 2. In some aspects, the corona ring 212 may have an epoxy coating on portions thereof. The epoxy coating in some aspects may be 75-150 μm in thickness. In some aspects, the corona rings 212 are only epoxy coated on the curved side surface 804. In this aspect, no other surface of the corona ring 212 may be coated with the epoxy coating.

As shown in FIG. 8, a larger diameter aperture 812 may be sized to receive the fastener. The corona ring 212 may include a curved side surface 804 and a generally flat top surface 806. Additionally, the corona ring 212 may include a circular standoff portion 814. The circular standoff portion 814 may contact a bottom surface of the top plate 202 or a top surface of the bottom plate 204. In some aspects, the dimensions of the FIG. 8 corona ring 212 may be consistent with the dimensions of the FIG. 7 corona ring 212. In some aspects, the corona ring 212 illustrated in FIG. 7 may be utilized on the upper surface of the top plate 202 and the lower surface of bottom plate 204 as the larger diameter aperture 712 may be sized to receive the fastener head therein. In some aspects, the corona ring 212 illustrated in FIG. 8 may be utilized on the lower surface of the top plate 202 and the upper surface of bottom plate 204 as the aperture 812 may be sized to receive the fastener body therein.

Figure 9:
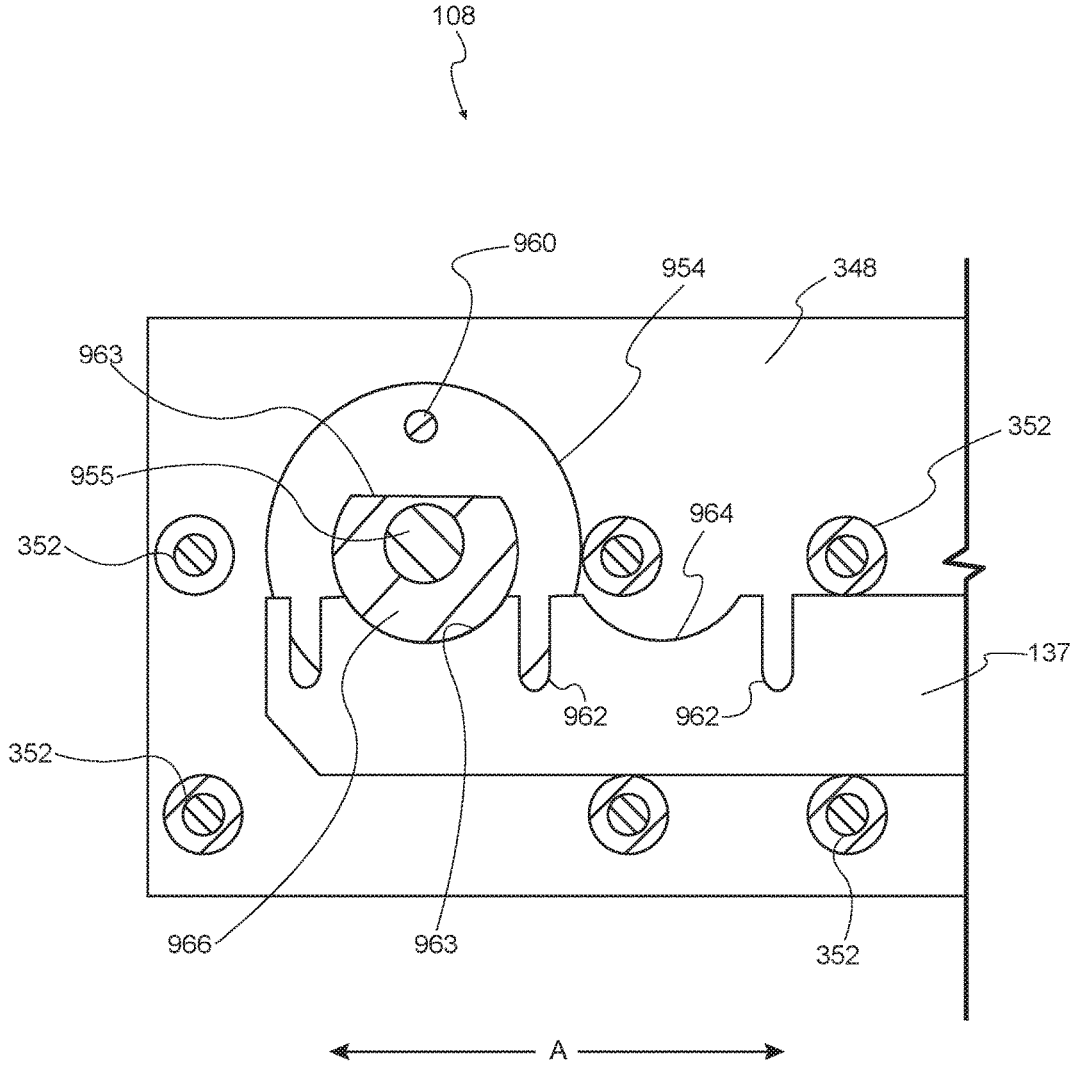
FIG. 9 illustrates details of a drive system according to an aspect of the disclosure.

FIG. 9 illustrates details of a drive system according to an aspect of the disclosure. In particular, the drive mechanism 108 for moving the movable contactor 106 between positions may be any type of drive mechanism providing linear movement. In one aspect, the drive mechanism 108 may be a Geneva Drive. In this aspect, the Geneva Drive may be implemented as a linear Geneva Drive with a drive wheel 954 implemented as a Geneva drive wheel configured with a drive pin 960 and the rack 137 may be a Geneva drive rack. The rack 137 may be mounted to the end of the drive shaft 138 as noted above and the drive wheel 954 for rotation with its drive pin 960 engaged with slots of the rack 137. In one aspect, a size of the drive wheel 954, and mating drive rack teeth 962 may be selected so that one complete turn of the drive wheel 954 may result in translation of the movable contactor 106 to the next switch position at which the contact louvers 163 of the movable contactor 106 engage with the internal walls of the electrical contacts 126 in the next adjacent pair of fixed contact units 104.

In this regard the drive mechanism 108 may include a hub 966 provided in the drive wheel 954. It should be noted that the drive rack teeth 962 in the rack 137 may be spaced equal distances apart and are separated by an arcuate surface 964. The hub 966 may have a curved surface 965 and a flat surface 963. The radius of curvature of the curved surface 965 may be equal to the radius of curvature of the arcuate surfaces 964. The hub 966 may be used to lock the rack 137 in a fixed position once the movable contactor 106 has been located in electrical communication with the electrical contact 126. This is accomplished by rotation of the drive wheel 954 until the curved surface 965 on the hub 966 is seated in the arcuate surface 964 on the rack 137. The rack 137 may be moved by rotating the drive pin 960 into engagement with one of the drive rack teeth 962. As the hub 966 is rotated to seat the drive pin 960 in the drive rack teeth 962, the flat surface 963 may move out of the arcuate surface 964. Continued rotation of the drive wheel 954 may drive the rack 137 in one direction or the other along the direction of arrows A. The flat surface 963 provided on the hub 966 allows the drive shaft 138 to move when the drive pin 960 is seated is one of the drive rack teeth 962.

The rack 137 may be moved from the first position to the second position by the drive mechanism 108 which may include the drive wheel 954 mounted for rotary motion on a shaft 955 between the plates 348. The drive pin 960 may be rotatable into the drive rack teeth 962 that may be provided on one edge of the rack 137. In each full revolution of the drive wheel 954, the drive pin 960 may move into one of the drive rack teeth 962 during the first half revolution of the wheel and back to the original position in the final rotation of the drive wheel 954.

In further aspects, the drive mechanism 108 may include more than one drive pin 960 (not shown). For example, two drive pins 960. Accordingly, each full revolution of the drive wheel 954, the drive pins 960 may move into two of the drive rack teeth 962 during a revolution of the drive wheel 954.

Figure 10:
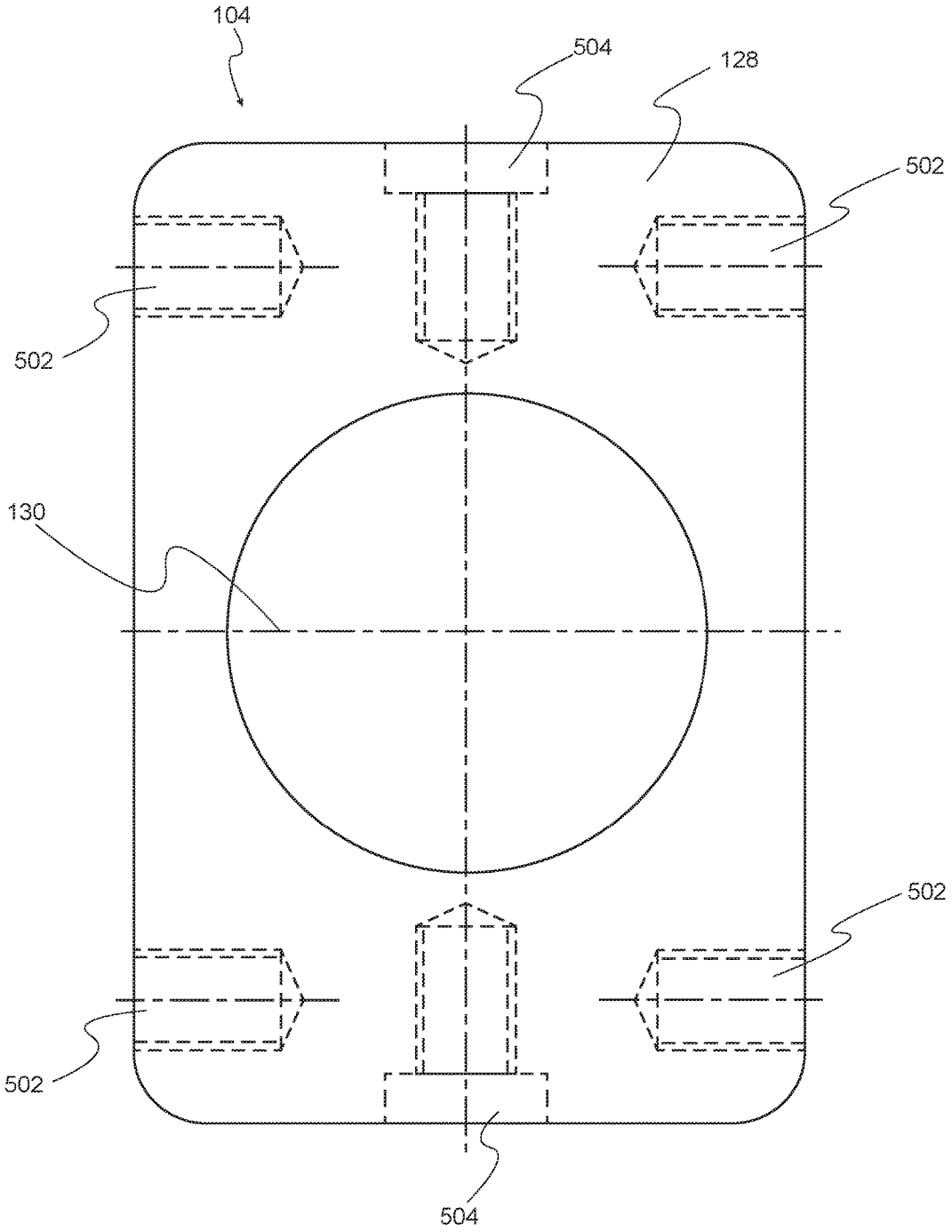
FIG. 10 illustrates a side view of a fixed contact unit according to an aspect of the disclosure.
Figure 11:
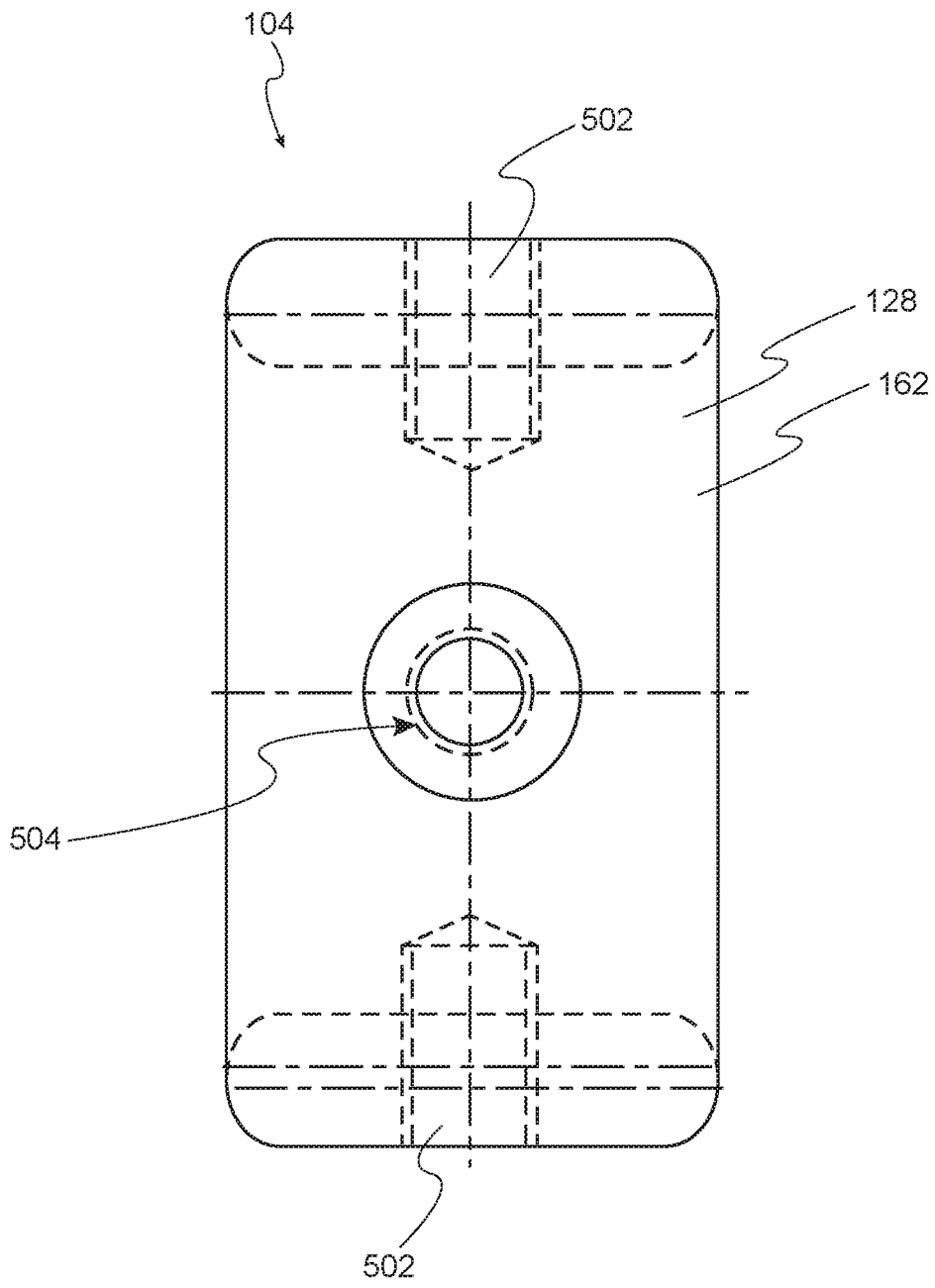
FIG. 11 illustrates a front view of the fixed contact unit according to FIG. 10.
Figure 12:
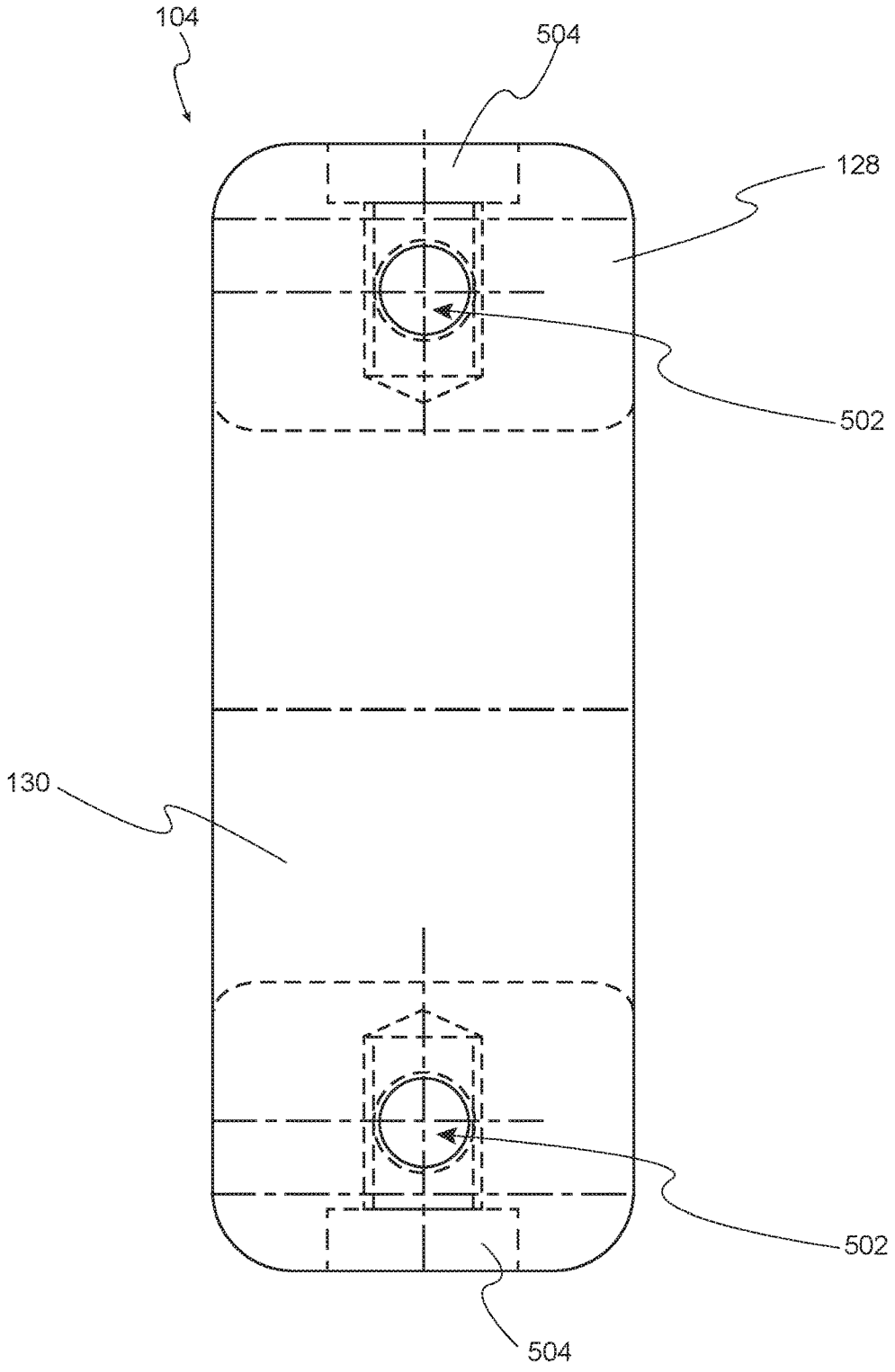
FIG. 12 illustrates a top view of the fixed contact unit according to FIG. 10.
Figure 13:
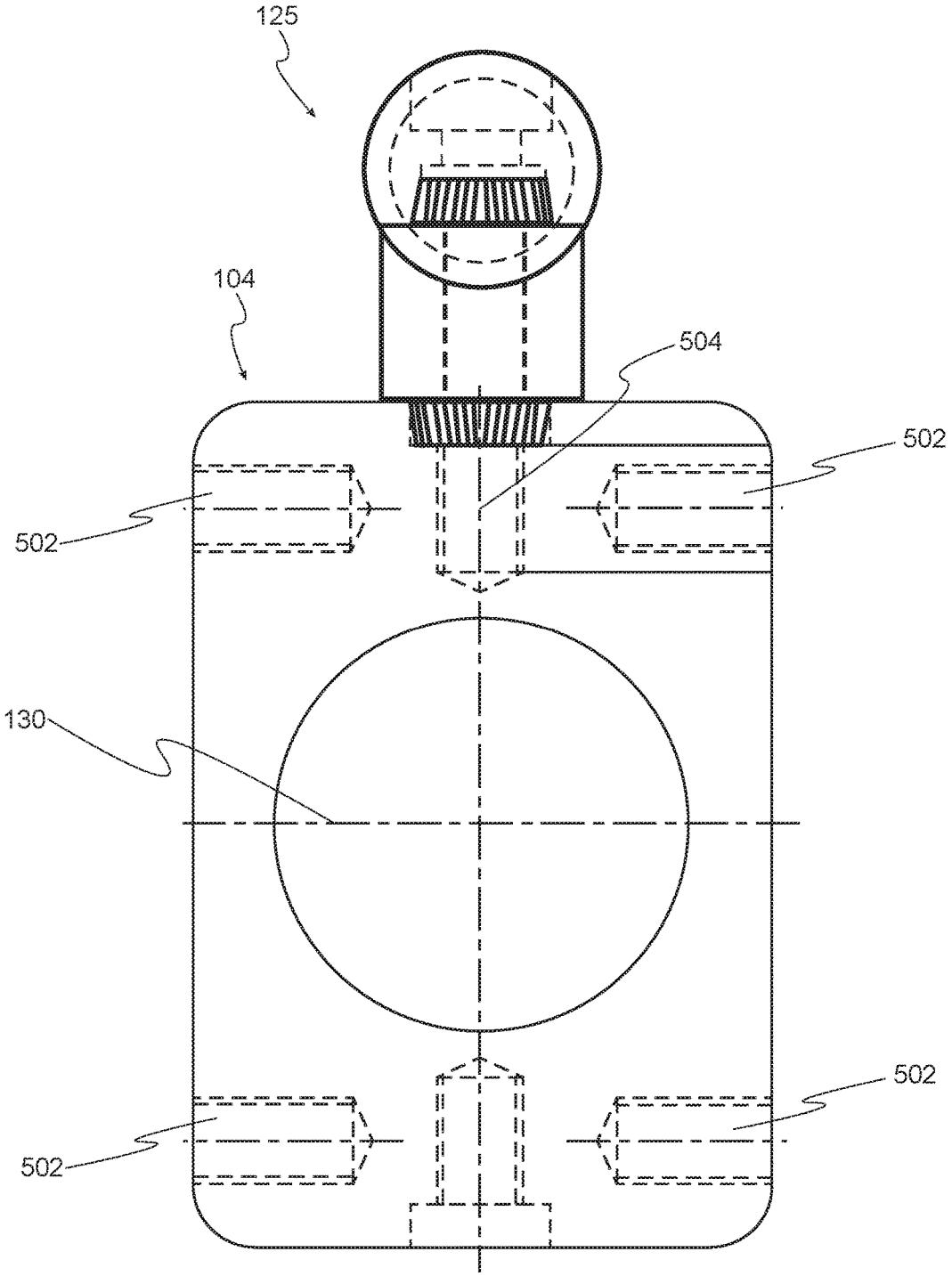
FIG. 13 illustrates a side view of the fixed contact unit and electrical contact according to an aspect of the disclosure.

FIG. 10 illustrates a side view of a fixed contact unit according to an aspect of the disclosure; FIG. 11 illustrates a front view of the fixed contact unit according to FIG. 10; FIG. 12 illustrates a top view of the fixed contact unit according to FIG. 10; and FIG. 13 illustrates a side view of the fixed contact unit and electrical contact according to an aspect of the disclosure. In particular, FIGS. 10-13 further show apertures 502 arranged on the insulating body 128. The apertures 502 may be configured to receive the fastener 214. In particular, the apertures 502 may be threaded for receiving a threaded implementation of the fastener 214.

FIGS. 10-13 further show apertures 504 configured to receive the electrical connector 125. In particular, the apertures 504 may be threaded for receiving a threaded fastener for connection to the electrical connector 125.

Figure 14A:
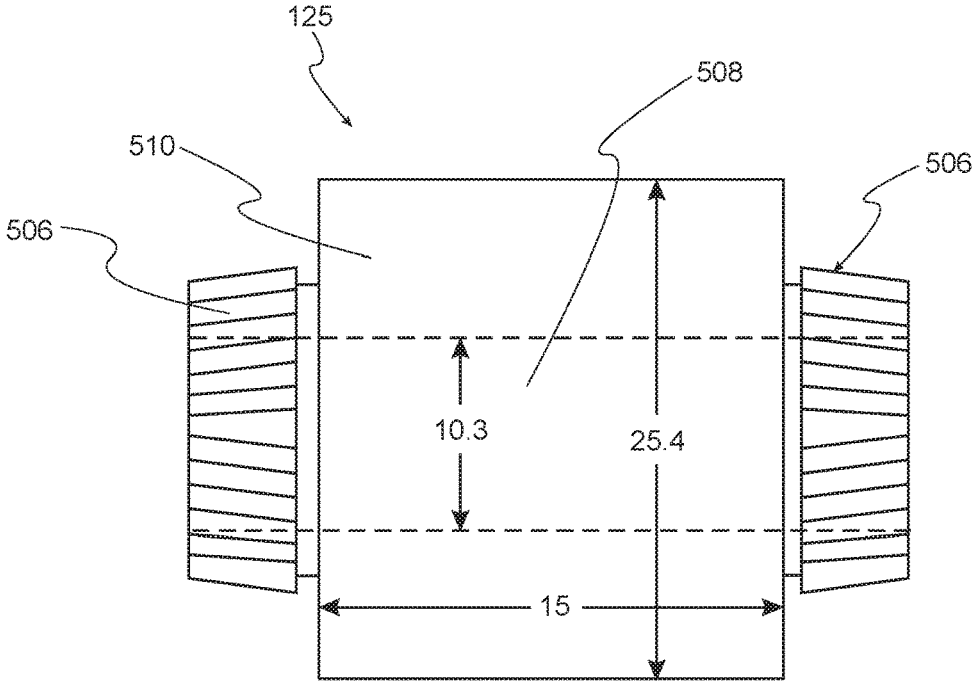
FIG. 14A illustrates a side view of an electrical contact according to an aspect of the disclosure.
Figure 14B:
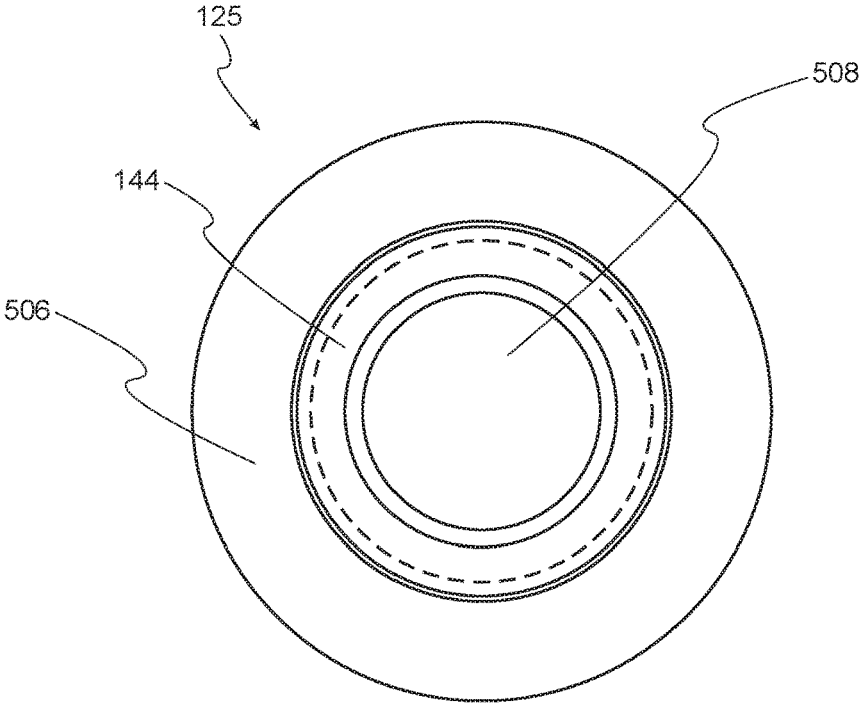
FIG. 14B illustrates a front view of an electrical contact according to FIG. 14A.

FIG. 14A illustrates a side view of an electrical contact according to an aspect of the disclosure; and FIG. 14B illustrates a front view of an electrical contact according to FIG. 14A. In particular, FIGS. 14A and 14B illustrate a first portion 510 of the electrical connector 125. The first portion 510 may include end portions 506. The end portions 506 may include a grooved circumference. The end portions 506 may further include an aperture 508 that extends through the end portions 506 and the first portion 510. The end portions 506 may further include a threaded portion or the tapped hole 144. The electrical connector 125 may have dimensions consistent with the particular application. In one aspect, the electrical connector 125 may have a height of 22-28 mm, a width of 12-18 mm and have an aperture diameter of 8-12 mm. In one aspect, the electrical connector 125 may have a height of 23-27 mm, a width of 13-17 mm and have an aperture diameter of 9-11 mm. In one aspect, the electrical connector 125 may have a height of approximately 25.4 mm, a width of approximately 15 mm and have an aperture diameter of approximately 10.3 mm.

Figure 15:
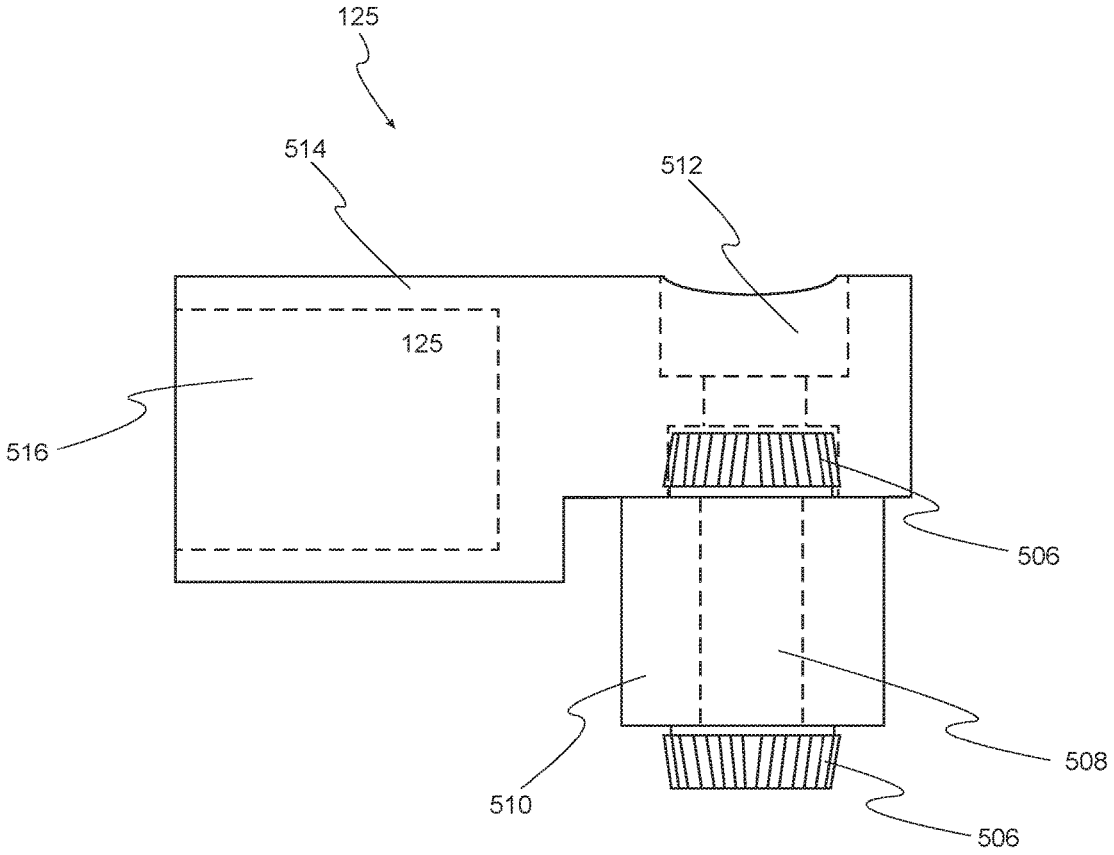
FIG. 15 illustrates a side view of an electrical contact according to an aspect of the disclosure.

FIG. 15 illustrates a side view of an electrical contact according to an aspect of the disclosure. In particular, FIG. 15 illustrates the first portion 510 connected to a second portion 514. The second portion 514 may include an aperture 512 configured to receive a fastener, such as a threaded fastener, therethrough for connecting to the first portion 510 to the second portion 514. The second portion 514 may further include an aperture 516 for receiving a fastener to connect to a transformer cable.

Figure 16:
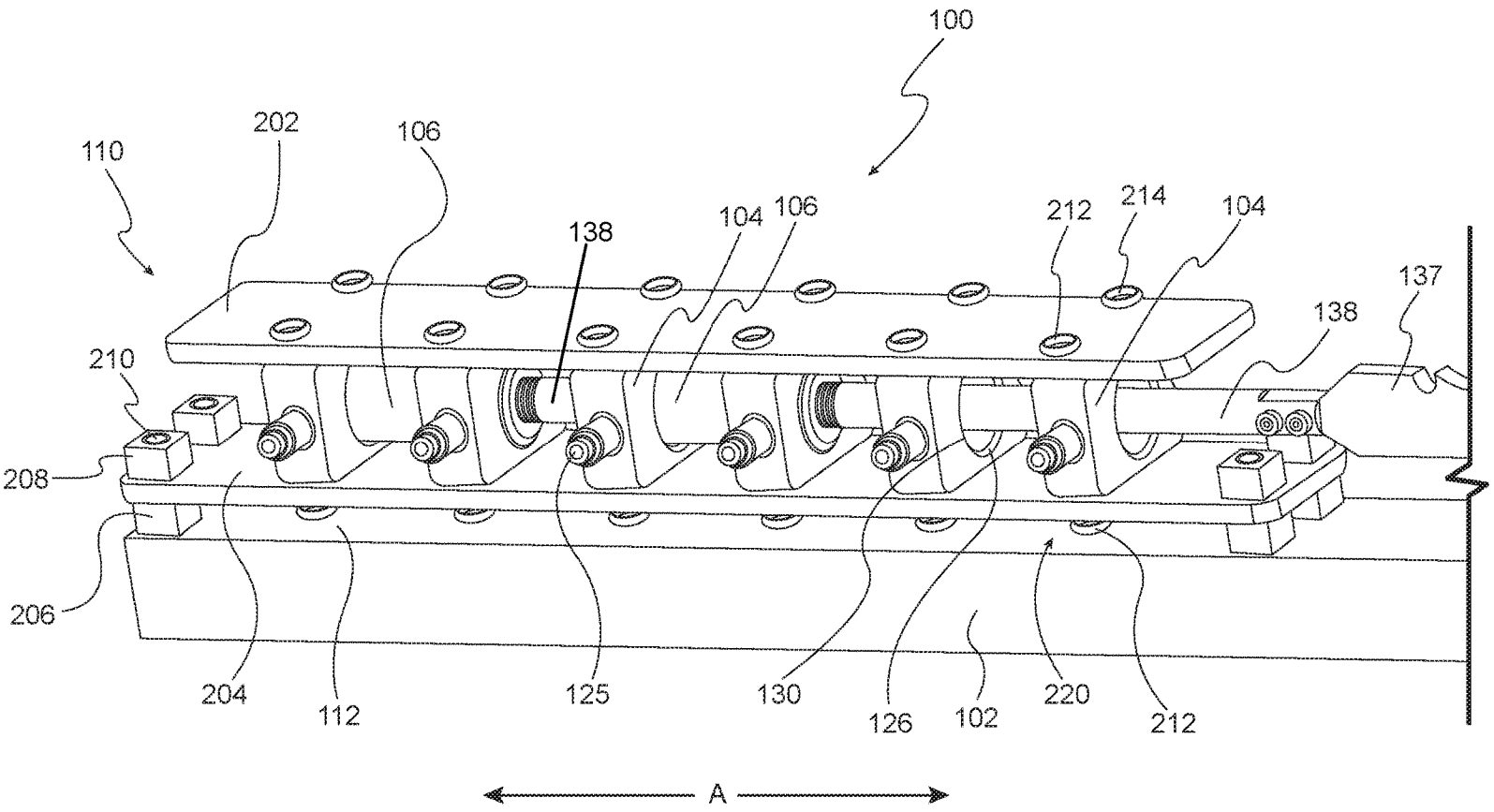
FIG. 16 illustrates a partial perspective view of another aspect of a switch for a tap changer in accordance with aspects of the disclosure.

FIG. 16 illustrates a partial perspective view of another aspect of a switch for a tap changer in accordance with aspects of the disclosure. In particular, FIG. 16 illustrates a tap changing switch 100 that includes a second movable contactor 106. This aspect may be utilized in implementations requiring a series parallel, a dual voltage, and/or a phase shifting functionality.

Figure 17:
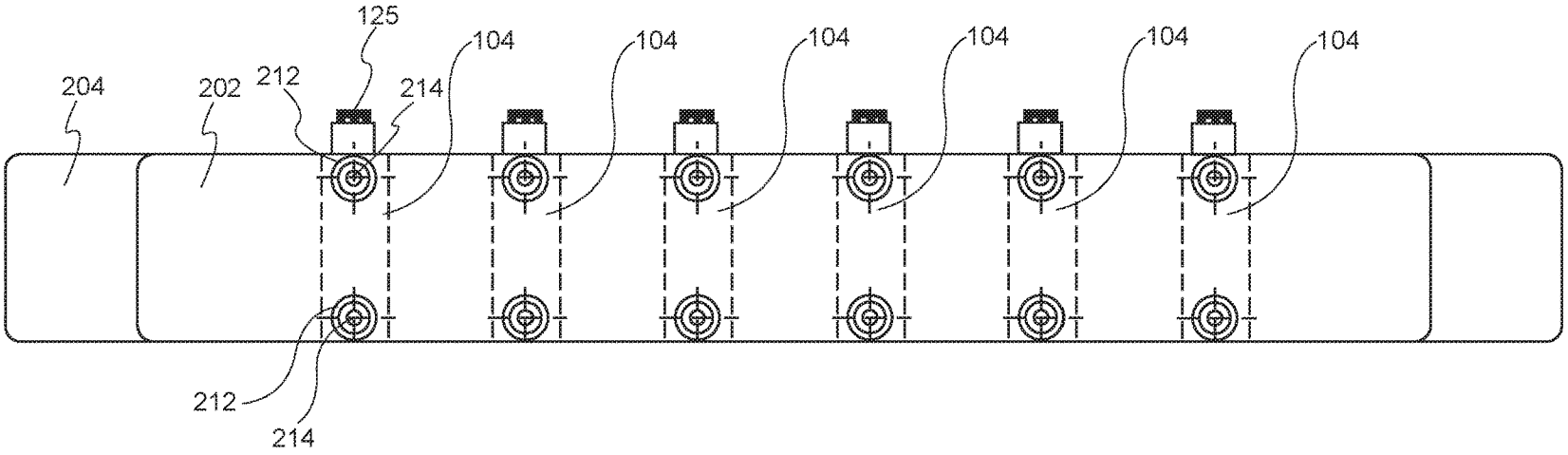
FIG. 17 illustrates a partial top view of another aspect of a switch for a tap changer in accordance with aspects of the disclosure.

FIG. 17 illustrates a partial top view of another aspect of a switch for a tap changer in accordance with aspects of the disclosure. In particular, FIG. 17 illustrates an aspect where the electrical connectors 125 are arranged on only one side of the tap changing switch 100. This arrangement may be beneficial based on implementations where the associated wires connecting to the electrical connectors 125 are desired to be located on one side for saving space, for manufacturing efficiency, ease of installation, and the like.

Figure 18:
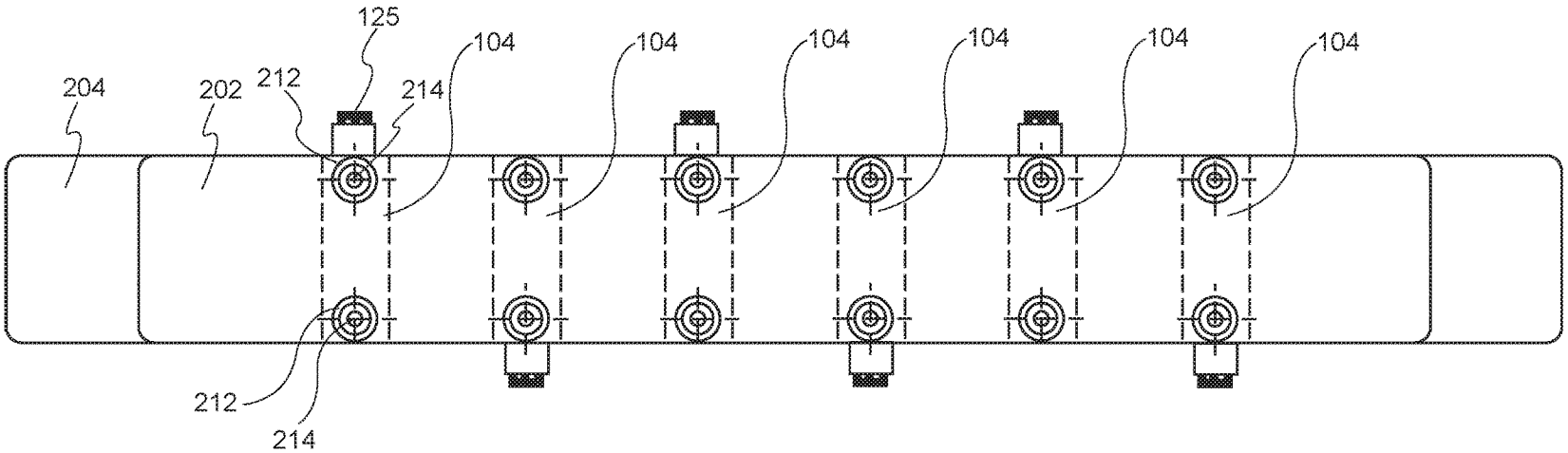
FIG. 18 illustrates a partial top view of another aspect of a switch for a tap changer in accordance with aspects of the disclosure.

FIG. 18 illustrates a partial top view of another aspect of a switch for a tap changer in accordance with aspects of the disclosure. In particular, FIG. 18 illustrates an aspect where the electrical connectors 125 are arranged in an alternating manner on both sides of the tap changing switch 100. This arrangement may be beneficial based on implementations where the associated wires connecting to the electrical connectors 125 are desired to be located on both sides for saving space, for manufacturing efficiency, ease of installation, and the like.

Figure 19:
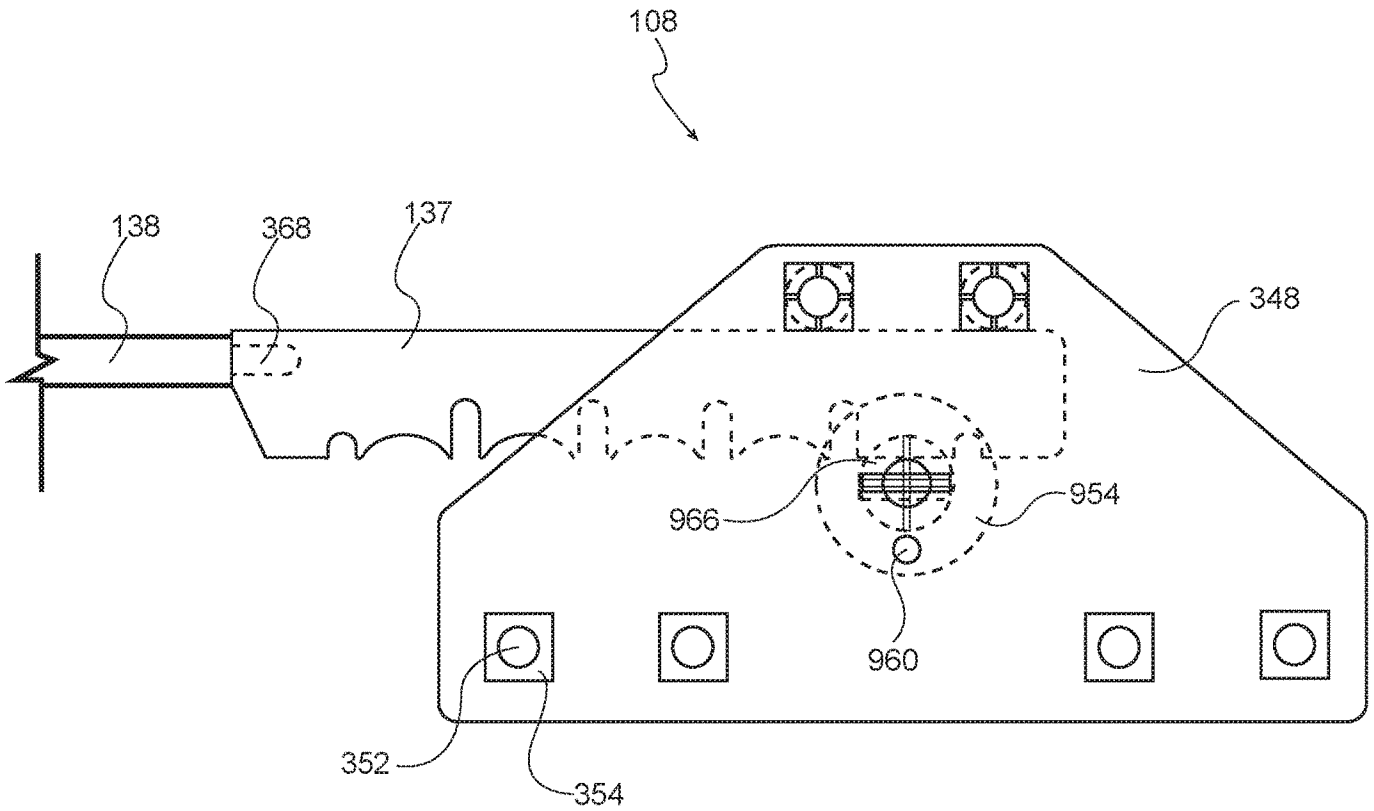
FIG. 19 illustrates a side view of another drive system according to an aspect of the disclosure.
Figure 20:
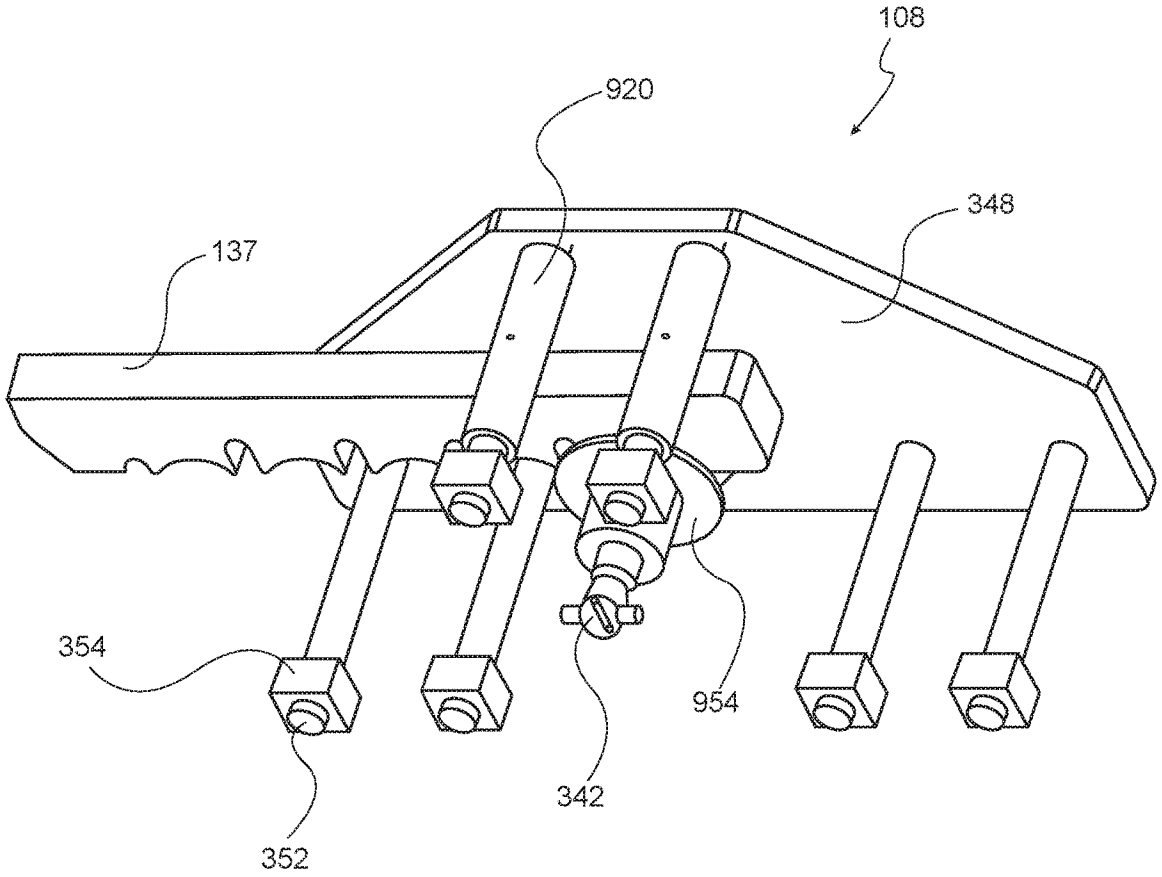
FIG. 20 illustrates a partial view of the drive system according FIG. 19.

FIG. 19 illustrates a side view of another drive system according to an aspect of the disclosure; and FIG. 20 illustrates a partial view of the drive system according FIG. 19. In particular, FIGS. 19 and 20 illustrate a drive mechanism 108 configured to operate similar to the drive mechanism described above. In this aspect, the drive mechanism 108 may include the elongated rack 137 inverted in comparison to the drive mechanism 108 of FIG. 9. Additionally, the drive mechanism 108 of FIGS. 19 and 20 may include rollers 920 to engage an upper surface of the elongated rack 137. The construction of the drive mechanism 108 illustrated in FIGS. 19 and 20 may further include a different connection to the drive shaft 138. In this regard, as illustrated in FIG. 19, the drive shaft 138 may include a reduced diameter male portion that may be threaded and the elongated rack 137 may include a threaded female portion 368 to receive the same.

Figure 21:
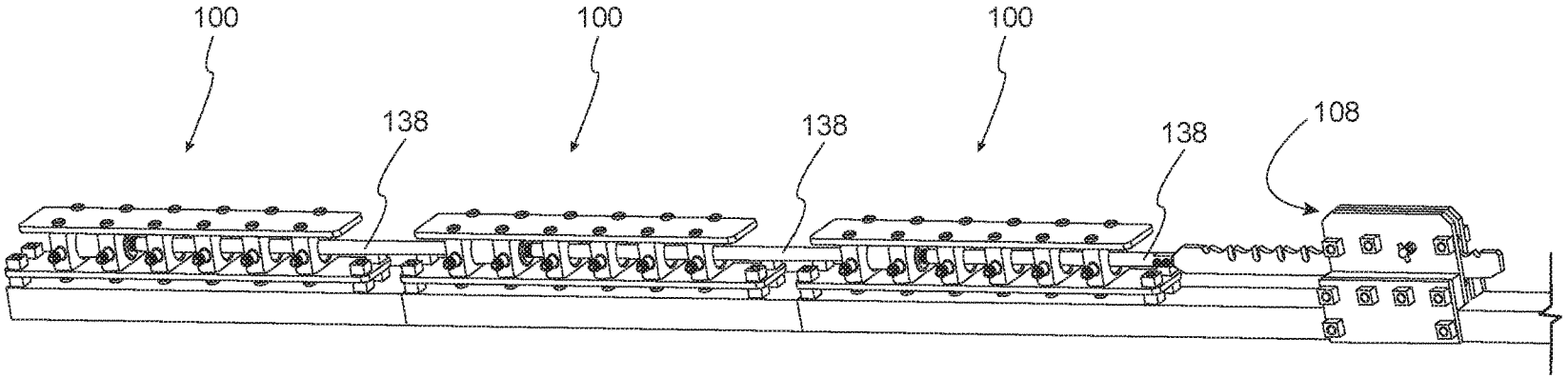
FIG. 21 illustrates a perspective view of another switch for a tap changer in accordance with aspects of the disclosure.

FIG. 21 illustrates a perspective view of another switch for a tap changer in accordance with aspects of the disclosure. In this regard, FIG. 21 shows a plurality of tap changing switches 100. In one aspect, there may be two tap changing switches 100. In one aspect, there may be three tap changing switches 100. In one aspect, there may be more than three tap changing switches 100. In one aspect, the tap changing switches 100 may be arranged on a common insulating base 102. In one aspect, the tap changing switches 100 may be controlled by a single drive mechanism 108. In one aspect, one or more the tap changing switches 100 may be connected to another one or more of the tap changing switches 100 by a drive shaft 138. The disclosure is particularly suited to be used with multi-phase transformer systems since identical tap changing switches 100 may be placed in parallel relationship. Because the tap changing switch 100 of the disclosure have a narrow profile which allows it to be tucked into this space, the tap changing switch 100 is no longer a controlling factor in tank size. If desired, a switch can also be mounted on top of the transformer core and coils, and because of its low and narrow profile does not require increased tank height for such mounting. The configuration of the tap changing switch 100 results in a smaller unit, a lighter weight, and reduced material costs relative to conventional units. Moreover, the construction of the tap changing switch 100 makes it easier to change service voltage of a transformer on site. Although well suited to use as a tap changing switch, the tap changing switch 100 of the disclosure may be used in any appropriate application, particularly where switches capable of carrying high current with low loss are required and switching can be done under de-energized conditions.

The many features and advantages of the disclosure are apparent from the detailed specification, and, thus, it is intended by the appended claims to cover all such features and advantages of the disclosure which fall within the true spirit and scope of the disclosure. Further, since numerous modifications and variations will readily occur to those skilled in the art, it is not desired to limit the disclosure to the exact construction and operation illustrated and described, and, accordingly, all suitable modifications and equivalents may be resorted to that fall within the scope of the disclosure.

What is claimed is:

1. A switch comprising:

an insulating base having an upper surface;

an assembly having a mounting surface, the assembly configured to be arranged on the insulating base, the assembly having a lower surface, the assembly being configured to be arranged on the upper surface of the insulating base with an open space between the lower surface of the assembly and the upper surface of the insulating base;

a plurality of fixed contact units mounted in an aligned arrangement on the mounting surface of the assembly, each of the plurality of fixed contact units comprising an insulating body with a bore therethrough;

an electrical contact embedded in the insulating body of each of the plurality of fixed contact units and the bore of the insulating body having the electrical contact arranged in the insulating body, the plurality of fixed contact units mounted to the mounting surface of the assembly such that the bore of the insulating body and electrical contacts of the fixed contact units are linearly aligned;

a movable contactor mounted to move within the bore of the insulating body and the electrical contacts of the plurality of fixed contact units, the movable contactor having a cylindrical body with contact louvers at spaced positions on the cylindrical body with the cylindrical body providing electrical conduction between the contact louvers, the movable contactor configured to slide within the fixed contact units with the contact louvers sized to engage the electrical contacts within the fixed contact units; and a drive shaft attached to the movable contactor configured such that the movable contactor is driven through the bore of the fixed contact units by moving the drive shaft whereby the movable contactor is configured to be moved from a position in which one of the contact louvers of the movable contactor engages the electrical contact in a first of the plurality of fixed contact units to a position wherein one contact louver engages the electrical contact within another one of the plurality of fixed contact units.

2. The switch of claim 1 wherein the assembly comprises a bottom plate and a top plate and the plurality of fixed contact units and the movable contactor are arranged between the bottom plate and the top plate.

3. The switch of claim 1 wherein the assembly comprises a bottom plate and a top plate and the plurality of fixed contact units are arranged between the bottom plate and the top plate; and wherein the bottom plate and the top plate are comprised of a thermosetting resin polymer.

4. The switch of claim 1 wherein the assembly comprises a bottom plate and a top plate and the plurality of fixed contact units and the movable contactor are arranged between the bottom plate and the top plate; and wherein the assembly is mechanically fastened to the insulating base.

5. The switch of claim 1 wherein the assembly comprises a bottom plate and a top plate and the plurality of fixed contact units are fastened to the bottom plate and the top plate with a plurality of fasteners.

6. The switch of claim 1 wherein the electrical contact in each of the plurality of fixed contact units comprises a silver plated metallic electrical contact with a cylindrical internal bore.

7. The switch of claim 1 wherein the movable contactor has a generally elongated cylindrical body of conductive metal having a silver plating.

8. The switch of claim 1 wherein the plurality of fixed contact units mounted in an aligned arrangement on the mounting surface of the assembly are configured with an open space between each of the plurality of fixed contact units.

9. The switch of claim 1 wherein the assembly comprises a bottom plate and a top plate and the plurality of fixed contact units are fastened to the bottom plate and the top plate with a plurality of fasteners that each extend through corona rings.

10. The switch of claim 9 wherein the corona rings are arranged below the bottom plate and above the top plate of the assembly.

* * * * *